US010856715B2

(12) United States Patent
Van Der Kooi et al.

(10) Patent No.: US 10,856,715 B2
(45) Date of Patent: Dec. 8, 2020

(54) NOZZLE ARRANGEMENT OF A CLEANING DEVICE FOR CLEANING A SURFACE

(71) Applicant: KONINKLIJKE PHILIPS N.V., Eindhoven (NL)

(72) Inventors: Johannes Tseard Van Der Kooi, Eindhoven (NL); Britt Roumen, Eindhoven (NL); Pieter Kingma, Eindhoven (NL); Matthijs Hendrikus Lubbers, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 407 days.

(21) Appl. No.: 14/432,518

(22) PCT Filed: Jan. 16, 2014

(86) PCT No.: PCT/IB2014/058328
§ 371 (c)(1),
(2) Date: Mar. 31, 2015

(87) PCT Pub. No.: WO2014/122542
PCT Pub. Date: Aug. 14, 2014

(65) Prior Publication Data

US 2015/0327743 A1 Nov. 19, 2015

Related U.S. Application Data

(60) Provisional application No. 61/761,799, filed on Feb. 7, 2013.

(51) Int. Cl.
*A47L 11/40* (2006.01)
*A47L 9/04* (2006.01)
(Continued)

(52) U.S. Cl.
CPC ..... *A47L 11/4041* (2013.01); *A47L 7/0009* (2013.01); *A47L 9/0411* (2013.01);
(Continued)

(58) Field of Classification Search
CPC ..... A47L 11/408; A47L 11/4077; A47L 9/04
(Continued)

(56) References Cited

U.S. PATENT DOCUMENTS 2,293,722 A * 8/1942 Erickson ..... A47L 5/30 15/320
2,949,620 A * 8/1960 Noble ..... A47L 11/302 15/321

(Continued)

FOREIGN PATENT DOCUMENTS

| | | | |
|---|---|---|---|
| EP | 2279686 | A2 | 2/2011 |
| EP | 2343003 | A1 | 7/2011 |
| WO | 2010041184 | A1 | 4/2010 |

*Primary Examiner* — Bryan R Muller

(57) ABSTRACT

The present invention relates to a nozzle arrangement (10) of a cleaning device (100) for cleaning a surface (20), comprising: —a nozzle housing (28); —a rotating brush (12) that is rotatable about a brush axis (14) and comprises a substantially cylindrical core element (52) with flexible brush elements (16) that are arranged on a circumferential surface (56) of the core element (52), wherein said brush elements (16) are configured to contact the surface to be cleaned (20) and pick up dirt and liquid particles (22, 24) from the surface to be cleaned (20) during a rotation of the rotating brush (12); —a drive for driving the rotating brush (12); —a liquid supplying arrangement (58) for supplying a cleansing liquid (68) to the rotating brush (12); —a wiping element (32) for wiping dirt and liquid particles (22, 24) across or off the surface to be cleaned (20), wherein said wiping element (32) extends along a longitudinal direction (48), which is arranged substantially parallel to the brush axis (14), and wherein said wiping element (32) is arranged on a first
(Continued)

longitudinal side (27) of the rotating brush (12) where the brush elements (16) enter the nozzle housing (28) during the rotation of the rotating brush (12); and—at least one side sealing element (62*a, b*) for sealing a lateral side (82*a, b*) of the nozzle housing (28), wherein the at least one side sealing element (62*a, b*) is spaced apart from a transverse side (80*a, b*) of the core element (52) that is transverse to the circumferential surface (56) of the core element (52), such that a gap (84*a, b*) is defined between said transverse side (80*a, b*) of the core element (52) and the at least one side sealing element (62*a, b*); wherein the liquid supplying arrangement (58) is configured to also supply cleaning liquid (68) to said gap (84*a, b*).

19 Claims, 7 Drawing Sheets

(51) Int. Cl.
*A47L 7/00* (2006.01)
*A46B 11/00* (2006.01)
*A46B 13/00* (2006.01)

(52) U.S. Cl.
CPC ..... *A47L 9/0477* (2013.01); *A47L 11/4044* (2013.01); *A47L 11/4077* (2013.01); *A47L 11/4088* (2013.01); *A46B 11/001* (2013.01); *A46B 13/001* (2013.01)

(58) Field of Classification Search
USPC ..... 15/320–322, 399, 383–388, 300.1–422.2
See application file for complete search history.

(56) References Cited

U.S. PATENT DOCUMENTS

| | | | | | |
|---|---|---|---|---|---|
| 3,633,240 | A | | 1/1972 | Crener | |
| 3,699,607 | A | | 10/1972 | Putt | |
| 4,817,233 | A | * | 4/1989 | Waldhauser | A47L 11/30 15/320 |
| 4,864,682 | A | | 9/1989 | Bewley, Jr. | |
| 5,475,893 | A | * | 12/1995 | Sepke | A47L 9/066 15/364 |
| 5,722,109 | A | * | 3/1998 | Delmas | A47L 9/281 15/319 |
| 2006/0075596 | A1 | | 4/2006 | Bosses | |
| 2009/0078281 | A1 | | 3/2009 | Goff | |
| 2009/0281661 | A1 | | 11/2009 | Dooley | |
| 2012/0284950 | A1 | * | 11/2012 | De Wit | A47L 11/4041 15/320 |
| 2013/0025077 | A1 | * | 1/2013 | De Wit | A47L 11/292 15/21.1 |

* cited by examiner

NOZZLE ARRANGEMENT OF A CLEANING DEVICE FOR CLEANING A SURFACE

This application is the U.S. National Phase application under 35 U.S.C. § 371 of International Application No. PCT/IB2014/058328, filed on Jan. 16, 2014, which claims the benefit of U.S. Provisional Application No. 61/761,799 filed on Feb. 7, 2013. These applications are hereby incorporated by reference herein.

FIELD OF THE INVENTION

The present invention relates to a nozzle arrangement of a cleaning device for cleaning a surface. Further, the present invention relates to a cleaning device with such a nozzle arrangement.

BACKGROUND OF THE INVENTION

Hard floor cleaning these days is done by first vacuuming the floor, followed by mopping it. Vacuuming removes the coarse dirt, while mopping removes the stains. From the state of the art many appliances, especially targeting the professional cleaning sector, are known that claim to vacuum and mop in one go. Appliances for the professional cleaning sector are usually specialized for big areas and perfectly flat floors. They rely on hard brushes and suction power to get water and dirt from the floor. Appliances for home use often use a combination of a hard brush and a squeegee nozzle. Like the appliances for the professional cleaning sector these products use the brush to remove stains from the floor and the squeegee in combination with an under-pressure to lift the dirt from the floor.

Said squeegee elements are usually realized by a flexible rubber lip that is attached to the bottom of the cleaning device and merely glides over the surface to be cleaned thereby pushing or wiping dirt particles and liquid across or off the surface to be cleaned. An under-pressure, usually generated by a vacuum aggregate, is used to ingest the collected dirt particles and liquid.

A vacuum cleaner of the prior art that uses a combination of a rotating brush and a squeegee is known from U.S. Pat. No. 4,864,682 A. This vacuum cleaner comprises a self-adjusting wiper strip assembly that automatically adjusts for the type of floor surface on which the vacuum cleaner is being used. The assembly used therein requires a high suction power in order to receive a satisfactory cleaning result. The brush which is used in this vacuum cleaner is an agitator (also denoted as adjutator) with stiff brush hairs to agitate the floor. These stiff hairs show a rather good scrubbing effect, which enable to use the brush particularly for removing stains. However, the performance on drying the floor is rather low, since such an agitator is not able to lift liquid from the floor.

Vacuum and mop in one go devices known from the prior art often use brush elements that are actively sprayed with water or a cleaning rinse in order to improve the removal of stains. Such devices usually use a double squeegee element having two squeegees that are arranged on one side of the brush. An additional vacuum source generates a suction in a channel between said double squeegee arrangement in order to remove the cleaning water from the floor again.

However, in order to remove the actively sprayed cleaning water from the floor again these devices always have to be moved in a forward direction in which the brush is, seen in the direction of the device movement, located in front of the double squeegee arrangement. Moving the device in an opposite backward direction would leave the floor wet, since the cleaning water, which is dispersed with the brush, is not removed from the squeegees in this backward stroke.

To get a good cleaning result in a forward as well as in a backward stroke of the device known cleaning devices are therefore provided with a double squeegee nozzle at both sides of the brush. Such an arrangement is exemplarily disclosed in U.S. Pat. No. 4,817,233 A. Even though such double squeegee arrangements on both sides of the brush show good cleaning results, nozzles of this type become fairly bulky. This again results in a non-satisfying, limited work capability. Especially in household appliances where often narrow corners need to be cleaned, such bulky nozzles are, due to their limited liberty of action, disadvantages and uncomfortable to use.

Another major disadvantage of wet floor cleaning appliances of the type shown in U.S. Pat. No. 4,817,233 A is that these devices are not able to clean the floor over the whole width of the nozzle. The longitudinal length of the rotating brush determines the area that is cleaned on the floor. The nozzle housing is in most of the cases larger than the brush. This is more or less per definition, since the area around the brush, i.e. also on the transverse sides of the brush, has to be at least partly sealed. Water would otherwise spray out on the transverse sides (short sides) of the nozzle without being ingested or lifted again. If the nozzle housing is larger than the brush, the strip that is cleaned while moving the nozzle in one direction will be smaller than the width of the nozzle housing itself. Especially when reaching corners, plinths and furniture, consumers experience this as a big disadvantage. A small non-cleaned strip will always be left over on the floor if the nozzle is e.g. moved parallel to a plinth.

Some prior art solutions tried to optimize the above-mentioned problem. Most of them however failed. Just enlarging the width of the brush does not solve the problem. A space-consuming drive mechanism is always necessary to rotate the brush. This results at least on one side of the nozzle in a relatively large non-cleaned area.

SUMMARY OF THE INVENTION

It is an object of the present invention to provide an improved nozzle arrangement for a cleaning device that shows, compared to the state of the art, an improved cleaning performance and has at the same time a nozzle of small size in order to guarantee a high liberty of action. It is particularly an object to provide a nozzle arrangement that enables to clean the floor over the whole width of the nozzle.

This object is achieved by a nozzle arrangement that comprises:

a nozzle housing;

a rotating brush that is rotatable about a brush axis and comprises a substantially cylindrical core element with flexible brush elements that are arranged on a circumferential surface of the core element, wherein said brush elements are configured to contact the surface to be cleaned and pick up dirt and liquid particles from the surface to be cleaned during a rotation of the rotating brush;

a drive for driving the rotating brush;

a liquid supplying arrangement for supplying a cleansing liquid to the rotating brush;

a wiping element for wiping dirt and liquid particles across or off the surface to be cleaned, wherein said wiping element extends along a longitudinal direction, which is arranged substantially parallel to the brush axis, and wherein said wiping element is arranged on a first longitudinal side of the rotating brush where the brush elements enter the nozzle housing during the rotation of the rotating brush; and at least one side sealing element for sealing a lateral side of the nozzle housing, wherein the at least one side sealing element is spaced apart from a transverse side of the core element that is transverse to the circumferential surface of the core element, such that a gap is defined between said transverse side of the core element and the at least one side sealing element;

wherein the liquid supplying arrangement is configured to also supply cleansing liquid to said gap.

The above-mentioned object is furthermore, according to a second aspect of the present invention, achieved by a cleaning device for cleaning a surface, comprising:

the above-mentioned nozzle arrangement; and a vacuum aggregate for generating an under-pressure in a suction-area between the nozzle housing and the rotating brush.

Preferred embodiments of the invention are defined in the dependent claims. It shall be understood that the claimed cleaning device has similar and/or identical preferred embodiments as the claimed nozzle arrangement and as defined in the dependent claims.

The presented nozzle arrangement comprises a rotating brush. This rotating brush is equipped with flexible micro-fiber bristles, which are herein denoted as flexible brush elements. Due to these flexible brush elements the brush is, in contrast to agitators with stiff brush elements, able to not only pickup dirt particles, but also to pickup liquid. The characteristics and material properties of these flexible brush elements will be explained below in detail.

The presented nozzle arrangement preferably makes use of a rotating brush in combination with a wiping element. Said wiping element may e.g. be realized as a second rotating brush that is counter-rotating with respect to the first rotating brush (herein simply denoted as rotating brush), similar as proposed in WO 2010041184 A1. In this case the nozzle arrangement would comprise two rotating brushes, one running clockwise and the other one counterclockwise.

According to a preferred embodiment the wiping element comprises or is realized as a squeegee element for wiping dirt and liquid particles across or off the surface to be cleaned by contacting the surface to be cleaned with a free end of the squeegee element, wherein said squeegee element extends along the longitudinal direction and is attached to the nozzle housing on the first longitudinal side of the rotating brush where the brush elements enter the nozzle housing during the rotation of the rotating brush. Preferably, only a single squeegee element is used. The squeegee element may also be simply denoted as squeegee. Said squeegee preferably comprises a flexible rubber lip that is configured to glide over the surface to be cleaned and thereby wipe dirt and/or liquid particles across or off the floor during the movement of the nozzle.

The squeegee is preferably arranged on a side of the rotating brush where the brush elements enter the nozzle housing during the rotation of the brush. The squeegee is thus arranged on the side of the brush where the dirt particles and liquid droplets are released from the brush. Due to the flexibility of the brush elements, the brush elements act as a kind of whip that smashes off the dirt and/or liquid particles as soon as they are during their rotation released from the surface to be cleaned. This relies on the fact that the flexible brush elements are bent or indented as soon as they come into contact with the surface to be cleaned and straighten out as soon as they loose contact with the floor. This principle will be explained in detail further below.

One of the central features of the present invention is the way of distributing a cleansing liquid within the interior of the nozzle housing and the way the nozzle housing is sealed from the exterior. A liquid supplying arrangement is used to supply the cleansing liquid to the rotating brush. In contrast to prior art cleaning devices of this type the cleansing liquid is, however, not only supplied to the rotating brush itself, but also to a space that occurs within the nozzle housing next to the transverse sides (short sides) of the rotating brush. At least one side sealing element is provided for sealing a lateral side of the nozzle housing. This side sealing element is spaced apart from a transverse side of the core element of the rotating brush and preferably runs substantially parallel thereto. The transverse side of the core element shall denote the top or the bottom surface of the cylindrical core element, whereas the circumferential surface denotes the cylindrical surface area (also denoted as lateral surface) of the cylindrical core element.

By spacing the at least one side sealing element apart from one of the transverse sides of the core element of the rotating brush, a gap is defined between said transverse side of the core element and the at least one side sealing element.

Creating such a gap in combination with the usage of the above-mentioned side sealing element has several advantages. On the one hand it serves for space where the drive for driving the rotating brush can be installed. More important is however that the liquid supplying arrangement is, according to the present invention, configured to also supply cleansing liquid to said gap. This means that the area that is wetted by the appliance is not only defined by the length of the rotating brush. Since cleansing liquid is also sprayed into the above-mentioned gap between a transverse side of the rotating brush and the at least one side sealing element, the floor will be wetted in this area as well. The effectively wetted area is therefore enlarged. The floor may thus be wetted almost over the whole width of the nozzle. This simplifies the floor cleaning especially in corners and next to plinths.

The at least one side sealing element prevents cleansing liquid from getting sprayed out on the lateral sides of the nozzle. The at least one sealing element therefore preferably contacts the floor (surface to be cleaned) during use. It is preferably arranged on a bottom side of the nozzle housing.

A further major function of the at least one side sealing element is to prevent air from getting sucked into the nozzle housing at the lateral sides. An under-pressure is preferably applied within the nozzle housing by means of a vacuum aggregate. Without the at least one side sealing element an air leakage could occur at the lateral sides of the nozzle that could impede or negatively influence the generation of the under-pressure within the nozzle housing. Such an air leakage would produce an airstream that is substantially perpendicular to the transverse sides of the core element (i.e. along the longitudinal direction). Without the at least one side sealing element cleansing liquid, which is supplied into the mentioned gap, would maybe not even reach the floor, but get forced inwards into the nozzle towards the rotating brush by means of the resulting airstream.

In a preferred embodiment of the present invention the nozzle arrangement comprises two side sealing elements, a first side sealing element for sealing a first lateral side of the nozzle housing and a second side sealing element for sealing a second lateral side of the nozzle housing. Said first side sealing element is spaced apart from a first transverse side of the core element, such that a first gap is defined between said first transverse side of the core element and the first side sealing element. Said second side sealing element is spaced apart from a second transverse side of the core element that is opposite to the first transverse side, such that a second gap is defined between said second transverse side of the core element and the second side sealing element. In this embodiment the liquid supplying arrangement is preferably configured to supply the cleansing liquid to said first and said second gap.

In other words, according to this embodiment a gap is defined within the nozzle housing on each lateral side (short side) of the brush. Cleansing liquid is according to this embodiment sprayed to both gaps, i.e. to the left and the right side of the rotating brush. Since the side sealing elements may have a very thin cross-section, the floor is in this case wetted almost over the full width of the nozzle.

It may be noted that the floor is in the described gaps "only" wetted and not directly treated with the rotating brush. It has been shown that there is however still a cleaning effect in these areas. The floor is in these areas wetted and by means of the squeegee also stripped-off. For most types of dirt this has been shown to be enough. Consumers do not even recognize that the rotating brush does not extend over the full width of the nozzle, since the nozzle does not leave any non-wetted strip behind on its sides. The wetted area that is left behind the nozzle therefore appears to be much more uniform compared to state of the art wet cleaning appliances.

According to a further embodiment the liquid supplying arrangement is at least partly integrated in the core element of the rotating brush and comprises at least one first opening on the circumferential surface (surface area) of the cylindrical core element and at least one second opening on or near said transverse side of the core element. More preferably, the liquid supplying arrangement comprises a plurality of openings on the circumferential surface of the core element and at least one opening on or near each of the first and the second transverse sides of the core element (i.e. one opening on each of the base sides of the cylindrical core element). "Near each of the first and the second transverse sides" in this case means that the at least one second opening does not necessarily need be arranged on one or each of the transverse sides of the core element, but may be also arranged on the circumferential surface of the core element close to said transverse side(s). A distance between the second opening and one of the transverse sides of the core element is preferably less than 10 mm, more preferably less than 5 mm.

Integrating the liquid supply within the core element of the rotating brush realizes a very space-saving arrangement. No extra liquid supplying tubes have to be arranged on the exterior surfaces of the rotating brush. By applying the above-mentioned openings within the core element the cleansing liquid may simply drizzle out through the openings. Due to the rotation of the rotating brush a relatively high centrifugal force is applied to the cleansing liquid. The cleansing liquid therefore sprays out through the openings of the core element with a high speed in an outward direction. As a result of the high centrifugal force and the resulting high speeds of the cleansing liquid, the cleansing liquid leaves the openings as a cloud of mist. The cleansing liquid is therefore very evenly distributed over the length of the rotating brush. Through the at least one opening on each of the transverse sides of the core element the cleansing liquid may also drizzle out and spray into the above-mentioned gaps between the rotating brush and the at least one side sealing element.

In order to receive an equal distribution of the cleansing liquid on the rotating brush as well as in the described gaps, the above-mentioned openings are preferably distributed over the core element. The cleansing liquid in the meaning of the present invention may comprise several different types of liquid. It may also simply contain water. Preferably, a combination of water and soap is used.

According to a further embodiment the liquid supplying arrangement is configured to supply the cleansing liquid through the at least one first opening at a maximum flow rate of 60 ml per minute and through the at least one second opening at a maximum flow rate of 10 ml per minute. In a preferred embodiment the core element comprises a plurality of first openings that are arranged on the circumferential surface of the core element and one second opening on each of the transverse sides of the core element, i.e. one opening on the first transverse side (left side) of the core element and one opening on the opposite transverse side (right side) of the core element. In this case the cleansing liquid drizzles out of the plurality of first openings at a maximum flow rate of 60 ml per minute and through each of the second side openings at a maximum flow rate of 10 ml per minute. The amount of 60 ml per minute shall denote the total amount that passes through the first plurality of openings together, such that on total (first and second openings together) a maximum flow rate of 80 ml per minute is established. This may, for example, be realized by arranging six openings on the circumferential surface of the core element and one opening on each of the transverse sides of the core element, wherein 10 ml per minute passes through each of said eight openings.

It shall be noted that the amount of cleansing liquid that is used according to the present invention is comparatively low. Due to the high rotational speeds of the rotating brush the cleansing liquid is fairly well distributed. A too high amount of cleansing liquid would thus wet the floor too much. Using only a small amount of cleansing liquid is apart from that also ecologically beneficial. In order not to wet the floor too much, it is according to an alternative embodiment especially preferred if the total flow rate per minute leaving through all openings together is smaller than 40 ml. Also in this case it is preferred that the flow rate per area is equally distributed, meaning that the gaps should be wetted with a similar amount of cleansing liquid per area as the rotating brush. This results in a uniform distribution of the cleansing liquid over the width of the nozzle.

A further advantage of only using a little amount of cleansing liquid is the possibility to also treat delicate surfaces, even surfaces which are indicated as being sensitive to liquid such as water. Furthermore, at a given size of a reservoir containing the cleansing liquid to be supplied to the rotating brush, an autonomy time is longer, i.e. it takes more time before the reservoir is empty and needs to be filled again.

According to a further preferred embodiment the at least one side sealing element is spring-loaded by means of a spring element in order to push said at least one side sealing element during use against the surface to be cleaned.

Spring-loading the side sealing element has the advantage that the side sealing element is pressed onto the floor with a fairly constant pressure. In case of any unevenness on the floor the at least one side sealing element is damped and may slightly move up and down. A constant contact between the free end of the at least one side sealing element and the floor is of great importance in order not to loose under-pressure and/or having cleansing liquid spraying out of the sides of the nozzle housing. The spring constant of the spring element may be adapted to the desired pressure that shall be realized between the at least one side sealing element and the floor. It is evident that this pressure should not be too high, since this could otherwise increase the scratch load on the floor.

Several materials have been tested by the applicant for the at least one side sealing element. The at least one side sealing element may be made of a rubber, like polyurethane, or a plastic material. Side sealing elements made of plastic or rubber have, however, sometimes shown a small water stripe at the position where the side sealing elements are moved over the floor.

According to a preferred embodiment of the present invention the at least one side sealing element therefore comprises a fixed brush with a plurality of bristles. These bristles are preferably made of synthetic or animal hair and have a bristle diameter of less than 0.8 mm, preferably less than 0.3 mm. Preferably a hydrophilic material is used, e.g. polyamide.

The term "fixed brush" is herein only used to distinguish between the rotating brush and the brush that forms the at least one side sealing element. The "fixed brush" is not rotated. It may however slightly move, especially move up and down due to the above-mentioned connection with the spring element. As the bristles of said fixed brush are flexible as well, these bristles may also move or bent during use. The "fixed brush" shall be herein also denoted as side brush. Preferably, two of these side brushes are used, one on each side of the nozzle. The side brushes have a sealing function as mentioned before. The side brushes should be therefore be configured to at least partly seal the lateral sides of the nozzle housing. It is clear to the skilled person that such a sealing function may only be realized by choosing a meaningful combination of a packing density of the bristles, material of the bristles, diameter of the bristles and a thickness of the side brush on total.

The usage of a brush with a plurality of flexible bristles for the side sealing element has several advantages: An extra advantage of such a brush is the scrubbing and cleaning effect that such a brush provides on the sides of the nozzle housing. Due to capillary effects some of the cleansing liquid that is sprayed into the above-mentioned gaps may be absorbed by said fixed brush and spread on the floor. If a brush is used as side sealing element, there is no clear separation between the exterior and the interior of the nozzle housing. Some amount of cleansing liquid will also be distributed on the floor by the fixed brush. This shows on the floor a nice fading between the wet area and the dry area.

In contrast to the usage of a rubber or plastic side sealing element no stripes therefore occur on the cleaned floor. The cleansing liquid sprays from the rotating brush against the side brushes (side sealing elements). Due to the fact that said side brushes (fixed brushes) are made from small fibers a small amount of cleansing liquid will enter the side brushes by capillarity. Due to the pressure difference between the outside of the nozzle housing and the inside of the nozzle housing some air will also be sucked through the side brushes and rinses together with the cleansing liquid all dirt from the side brushes. This results in a self-cleaning effect of the side brushes. Since there are no parts between the rotating brush and the side brushes, the dirt cannot stick to anything.

According to a further preferred embodiment at least a first part of said at least one side sealing element is arranged substantially perpendicular to the brush axis. In case the at least one side sealing element is realized by a fixed brush as mentioned before, the bristles of said brush may be arranged substantially perpendicular to the brush axis. In other words, the at least one side sealing element is preferably arranged parallel to the transverse sides of the core element of the rotating brush.

The at least one side sealing element should furthermore not be spaced too far apart from the squeegee element, since this could disturb the sealing effect. According to a preferred embodiment a distance between said first part of the at least one side sealing element (that is arranged perpendicular to the brush axis) and a lateral side of the squeegee element that is transverse to the longitudinal direction is smaller than 5 mm, preferably less than 2 mm. This distance has shown to be a good trade-off solution, which does not disturb the sealing effect that is provided by the at least one side sealing element. On the other hand, the at least one side sealing element does not disturb the action of the squeegee due to a contact between these two parts.

According to a further embodiment the nozzle arrangement additionally comprises a spoiler that is arranged on a second longitudinal side of the rotating brush opposite the first longitudinal side and extends substantially along said longitudinal direction, wherein said spoiler contacts the rotating brush and deflects the brush elements during the rotation of the rotating brush and at least partly restricts air from getting sucked into the nozzle housing at said second longitudinal side where the brush elements leave the nozzle housing during the rotation of the rotating brush.

As mentioned above, said spoiler has two main functions, it serves as a deflector and as a flow restriction. The spoiler presses the brush elements of the rotating brush together by deflecting them. In this way air, which is present in the space between the brush elements, is pushed out of said space. When the brush elements are, after leaving the spoiler, moved apart from each other again, the space in between the brush elements increases so that air will be sucked into the rotating brush, wherein an under-pressure is created that sucks in dirt and/or liquid particles. The deflector therefore compensates for a blowing effect of the rotating brush that is otherwise generated due to its rotation and the turbulent air stream that results therefrom.

The spoiler is apart from that configured to also restrict air from getting sucked into the nozzle housing at the second side of the rotating brush where the brush elements leave the nozzle housing during the rotation of the rotating brush. On this second side of the rotating brush (opposite to the position where the squeegee is arranged) it should be prevented that too much air is getting sucked into the nozzle housing, since this would result in less under-pressure, i.e. increase the absolute pressure within the so-called suction area in the nozzle housing. By at least partly restricting air from getting sucked into the nozzle housing at the above-mentioned second side of the rotating brush, the spoiler therefore prevents a loss of under-pressure in the areas of the nozzle housing where the under-pressure is needed to ingest the dirt and/or liquid particles.

The spoiler therefore also acts as a kind of sealing at the second longitudinal side of the rotating brush and thereby minimizes the requirements to the vacuum aggregate. A relatively small vacuum aggregate may therefore serve to apply a sufficiently high under-pressure within the nozzle housing. Such small vacuum aggregates are not only less space-consuming but also cheaper, so that production costs may be saved. On the other hand, small vacuum aggregates are less noisy compared to large powerful vacuum aggregates.

According to a further embodiment of the present invention the at least one side sealing element at least partly covers said lateral side of the nozzle housing, wherein a length of the at least one side sealing element is equal to or larger than a distance between a section of the squeegee element, that has a maximum distance to the spoiler, and a contact position where the spoiler contacts the rotating brush. In case two side sealing elements are applied, one on each lateral side of the nozzle housing, the length of each of the side sealing elements at least equals said distance between the squeegee element and the contact position of the spoiler with the rotating brush.

The at least one side sealing element therefore preferably covers the whole lateral area of the nozzle housing. It should be long enough in order to seal the whole lateral area between the squeegee and the contact position of the spoiler with the rotating brush. Since the squeegee flexes from an open to a close position depending on the movement direction of the nozzle, the at least one side sealing element should be long enough to cover the whole lateral area of the nozzle housing independent of the position of the squeegee (open or closed position). This will be explained in detail further below with reference to the drawings.

For the sealing effect it is on the other hand also important that the distance between the at least one side sealing element and the spoiler is not too large. According to a preferred embodiment of the present invention a distance between the at least one side sealing element and a lateral side of the spoiler that is transverse to the longitudinal direction is smaller than 5 mm, preferably smaller than 3 mm. The gap between the spoiler and the side sealing element is therefore minimized.

A further central point of the present invention relates to the design and the properties of the rotating brush that is used in the presented nozzle arrangement.

According to a preferred embodiment of the present invention the linear mass density of a plurality of the brush elements of the rotating brush is, at least at tip portions of said brush elements, lower than 150 g/10 km, preferably lower than 20 g/10 km.

In contrast to rotating brushes often used according to the prior art, which are only used for stain removal (agitators), a soft rotating brush with flexible brush elements as presented here also has the ability to pick-up water from the floor. Due to the flexible microfiber hairs that are preferably used as brush elements, dirt particles and liquid can be picked up from the floor when the brush elements/microfiber hairs contact the floor during the rotation of the rotating brush. The ability to also pick-up water with a rotating brush is mainly caused by capillary and/or other adhesive forces that occur due to the chosen linear mass density of the brush elements. The very thin microfiber hairs furthermore make the rotating brush open for coarse dirt. The microfiber hairs also have the advantage that the hairs serve as a flow restriction. Stiff hairs of an adjutator could instead not do so.

It is to be noted that the linear mass density as mentioned, i.e. the linear mass density in gram per 10 km, is also denoted as Dtex value. A very low Dtex value of the above-mentioned kind ensures that, at least at the tip portions, the brush elements are flexible enough to undergo a bending effect and are able to pick-up dirt particles and liquid droplets from the surface to be cleaned. Furthermore, the extent of wear and tear of the brush elements appears to be acceptable within this linear mass density range.

The experiments carried out by the applicant have proven that a Dtex value in the above-mentioned range appears to be technically possible and that good cleaning results can be obtained therewith. However, it has shown that cleaning results can be further improved by applying brush elements with an even lower upper limit of the Dtex value, such as a Dtex value of 125, 50, 20 or even 5 (in g/10 km).

According to a further preferred embodiment of the present invention the drive is adapted to realize a centrifugal acceleration at the tip portions of the brush elements which is, in particular during a dirt release period when the brush elements are free from contact to the surface during rotation of the brush, at least 3,000 $m/s^2$, more preferably at least 7,000 $m/s^2$, and most preferably 12,000 $m/s^2$.

It is to be noted that the minimum value of 3,000 $m/s^2$ in respect of the acceleration which is prevailing at the tip portions at least during a dirt release period when the brush elements are free from contact to the surface during the rotation of the rotating brush, is also supported by results of experiments which have been performed in the context of the present invention. These experiments have shown that the cleaning performance of the device according to the present invention improves with an increase of the angular velocity of the brush, which implies an increase of the acceleration at the tip portions of the brush elements during rotation.

When the drive is adapted to realize centrifugal accelerations of the brush elements in the above-mentioned ranges, it is likely for the liquid droplets adhering to the brush elements to be expelled as a mist of droplets during a phase in which the brush elements are free from contact to the surface to be cleaned.

Combining the above-mentioned parameters for the linear mass density of the flexible brush elements with the parameters for the acceleration of the tips of the brush elements yields optimal cleaning performance of the rotating brush, wherein practically all dirt particles and spilled liquid encountered by the rotating brush are picked up by the brush elements and expelled at a position inside the nozzle housing.

A good combination of the linear mass density and the centrifugal acceleration at the tip portions of the brush elements is providing an upper limit for the Dtex value of 150 g/10 km and a lower limit for the centrifugal acceleration of 3,000 $m/s^2$. This parameter combination has shown to enable for excellent cleaning results, wherein the surface is practically freed of particles and dried in one go. Using this parameter combination has also shown to result in very good stain removing properties. The ability to also pick-up liquid with a brush is mainly caused by capillary and/or other adhesive forces that occur due to the chosen linear mass density of the brush elements and the occurring high speeds with which the brush is driven.

In order to realize the above-mentioned centrifugal accelerations at the tip portions of the brush elements, the drive is, according to an embodiment of the present invention, adapted to realize an angular velocity of the brush which is in a range of 3,000 to 15,000 revolutions per minute, more preferably in a range of 5,000 to 8,000 revolutions per minute, during operation of the device. Experiments of the applicant have shown that optimal cleaning results can be obtained, when the rotating brush is driven at an angular velocity which is at least 6,000 revolutions per minute.

However, the desired accelerations at the tip portions of the brush elements do not only depend on the angular velocity, but also on the radius, respectively on the diameter of the rotating brush.

It is therefore, according to a further embodiment of the invention, preferred that the rotating brush has a diameter which is in a range of 10 to 100 mm, more preferably in a range of 20 to 80 mm, and most preferably in a range of 35 to 50 mm, when the brush elements are in a fully outstretched condition. The length of the brush elements is preferably in a range of 1 to 20 mm, more preferably in a range of 8 to 12 mm, when the brush elements are in a fully outstretched condition.

According to an embodiment of the claimed cleaning device the cleaning device further comprises a vacuum aggregate that is configured to generate an under-pressure within a suction-area between the nozzle housing, the rotating brush and the squeegee in a range of 3 to 70 mbar, preferably in a range of 4 to 50 mbar, most preferably in a range of 5 to 30 mbar.

In contrast to the above-mentioned pressure ranges that are generated by the vacuum aggregate, state of the art vacuum cleaners need to apply higher under-pressures in order to receive acceptable cleaning results. However, due to the above-mentioned combination of the special rotating brush with flexible brush elements and the squeegee element very good cleaning results may already be realized in the above-mentioned pressure ranges. Thus, also smaller vacuum aggregates may be used. This increases the freedom in the selection of the vacuum pump.

The presented cleaning device may further comprise positioning means for positioning the brush axis at a distance to the surface to be cleaned that is smaller than the radius of the rotating brush with fully outstretched brush elements, to realize an indentation of the brush part contacting the surface to be cleaned during operation, which indentation is in a range from 2% to 12% of the brush diameter.

As a result, the brush elements are bent when the rotating brush is in contact with the floor. Hence, as soon as the brush elements come into contact with the floor during rotation of the rotating brush, the appearance of the brush elements changes from an outstretched appearance to a bent appearance, and as soon as the brush elements lose contact with the floor during rotation of the rotating brush, the appearance of the brush elements changes from a bent appearance to an outstretched appearance. The same brush characteristics occur when the tip portions of the rotating brush contact the spoiler.

A practical range for an indentation of the brush is arranged from 2% to 12% of a diameter of the rotating brush relating to a fully outstretched condition of the brush elements. In practical situations, the diameter of the rotating brush as mentioned can be determined by performing an appropriate measurement, for example, by using a high-speed camera or a stroboscope which is operated at the frequency of a rotation of the brush.

A deformation of the brush elements or, to say it more accurately, a speed at which deformation can take place, is also influenced by the linear mass density of the brush elements. Furthermore, the linear mass density of the brush elements influences the power which is needed for rotating the brush. When the linear mass density of the brush elements is relatively low, the flexibility is relatively high, and the power needed for causing the brush elements to bend when they come into contact with the surface to be cleaned or with the first deflection surface is relatively low. This also means that a friction power which is generated between the brush elements and the floor or the first deflection surface is low, whereby any damages are prevented. Other advantageous effects of a relatively low linear mass density of the brush elements are a relatively high resistance to wear, a relatively small chance of damage by sharp objects or the like, and the capability to follow the surface to be cleaned in such a way that contact is maintained even when a substantial unevenness in the floor is encountered.

A factor which may play an additional role in the cleaning function of the rotating brush is a packing density of the brush elements. When the packing density is large enough, capillary effects may occur between the brush elements, which enhance fast removal of liquid from the surface to be cleaned. According to an embodiment of the present invention the packing density of the brush elements is at least 30 tufts of brush elements per $cm^2$, wherein a number of brush elements per tuft is at least 500.

Arranging the brush elements in tufts forms additional capillary channels, thereby increasing the capillary forces of the brush for picking-up dirt particles and liquid droplets from the surface to be cleaned.

As it has been mentioned above, the presented cleaning device has the ability to realize extremely good cleaning results. These cleaning results can be even improved by actively wetting the surface to be cleaned. This is especially advantageous in case of stain removal. The liquid used in the process of enhancing adherence of dirt particles to the brush elements may be provided in various ways. In a first place, the rotating brush and the flexible brush elements may be wetted by a liquid which is present on the surface to be cleaned. An example of such a liquid is water, or a mixture of water and soap. Alternatively, a liquid may be provided to the flexible brush elements by actively supplying the cleansing liquid to the brush, e.g. by injecting the cleansing liquid into the hollow core element of the brush, as mentioned above.

It has to be noted that, instead of using an intentionally chosen and actively supplied liquid, it is also possible to use a spilled liquid, i.e. a liquid which is to be removed from the surface to be cleaned. Examples are spilled coffee, milk, tea, or the like. This is possible in view of the fact that the brush elements, as mentioned before, are capable of removing the liquid from the surface to be cleaned, and that the liquid can be removed from the brush elements under the influence of centrifugal forces as described in the foregoing.

BRIEF DESCRIPTION OF THE DRAWINGS

These and other aspects of the invention will be apparent from and elucidated with reference to the embodiment(s) described hereinafter. In the following drawings

DETAILED DESCRIPTION OF THE INVENTION

Figure 1:
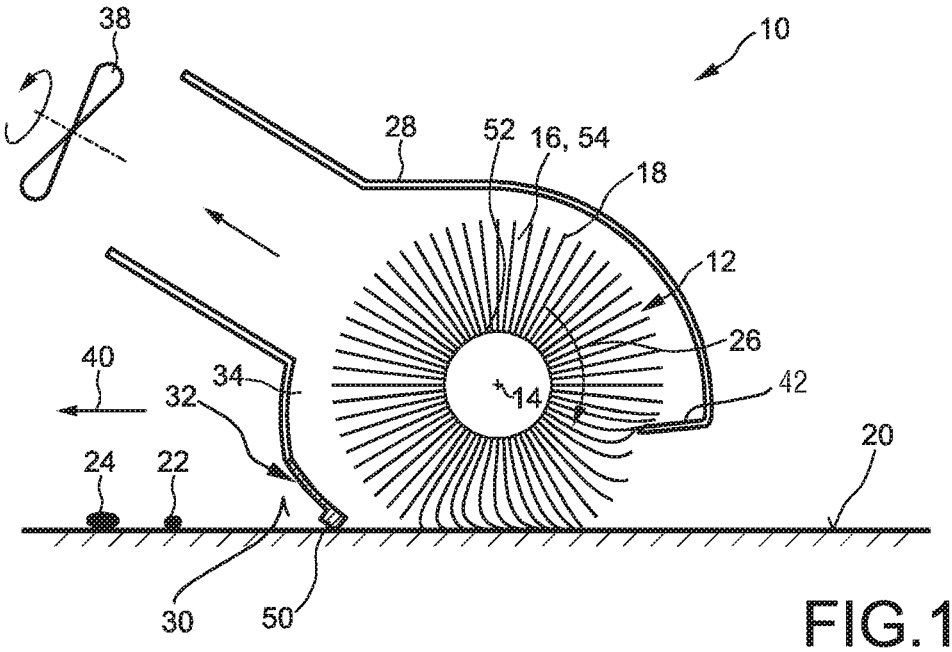
FIG. 1 shows a schematic cross-section of a first embodiment of a nozzle arrangement of a cleaning device according to the present invention in a first working position.

FIG. 1 shows a schematic cross-section of a first embodiment of a nozzle arrangement 10 of a cleaning device 100 according to the present invention. The nozzle arrangement 10 comprises a rotating brush 12 that is rotatable about a brush axis 14. Said rotating brush 12 is provided with flexible brush elements 16 which are preferably realized by thin microfiber hairs. The flexible brush elements 16 comprise tip portions 18 which are adapted to contact a surface to be cleaned 20 during the rotation of the brush 12 and to pick-up dirt particles 22 and/or liquid particles 24 from said surface 20 (floor 20) during a pick-up period when the brush elements 16 contact the surface 20.

Further, the nozzle arrangement 10 comprises a drive, e.g. a motor (not shown), for driving the rotating brush 12 in a predetermined direction of rotation 26. Said drive is preferably adapted to realize a centrifugal acceleration at the tip portions 18 of the brush elements 16 which is, in particular during a dirt release period when the brush elements 16 are free from contact to the surface 20 during the rotation of the brush 12, at least 3,000 $m/s^2$.

The rotating brush 12 is at least partly surrounded by a nozzle housing 28. The arrangement of the rotating brush 12 within the nozzle housing 28 is preferably chosen such that the rotating brush 12 at least partially protrudes from a bottom side 30 of the nozzle housing 28. During use of the device 100, the bottom side 30 of the nozzle housing 28 faces towards the surface to be cleaned 20.

Also attached to said bottom side 30 of the nozzle housing 28 is a squeegee element 32. This squeegee element 32 is arranged such that it contacts the surface to be cleaned 20 during the use of the device 100. The squeegee is used as a kind of wiper for wiping dirt and/or liquid particles 22, 24 across or off the surface 20 when the nozzle 10 is moved. The squeegee 32 extends substantially parallel to the brush axis 14 and is arranged on a first longitudinal side 27 of the rotating brush 12 where the brush elements 16 enter the nozzle housing 28 during the rotation of the brush 12. The nozzle housing 28, the squeegee 32 and the rotating brush 12 together define a suction area 34, which is located within the nozzle housing 28. It is to be noted that the suction area 34, in the meaning of the present invention, not only denotes the area between the rotating brush 12, the squeegee 32 and the nozzle housing 28, but also denotes the space between the brush elements 16 for the time during the rotation of the brush 12, in which the brush elements 16 are inside the nozzle housing 28. The suction area 34 denotes as well an area that is defined between the squeegee 32 and the rotating brush 12. The latter area will be in the following also denoted as suction inlet 36, which opens into the suction area 34.

By means of a vacuum aggregate 38, which is in these figures only shown in a schematic way, an under-pressure is generated in the suction area 34 for ingesting dirt and liquid particles 22, 24 that have been encountered and collected by the brush 12 and the squeegee 32. Said under-pressure preferably ranges between 3 and 70 mbar, more preferably between 4 and 50 mbar, most preferably between 5 and 30 mbar. This under-pressure is, compared to regular vacuum cleaners which apply an under-pressure of around 70 mbar, quite low. However, due to the properties of the rotating brush 12, which will be explained further below, very good cleaning results may already be realized in the above-mentioned pressure ranges. Thus, also smaller vacuum aggregates 38 may be used. This increases the freedom in the selection of the vacuum pump.

During the rotation of the rotating brush 12 dirt and/or liquid particles 22, 24 will be encountered on the surface 20 and either launched towards the inside of the nozzle housing 28 or against the squeegee 32. If the particles 22, 24 are launched against the squeegee 32 they will get reflected therefrom. These reflected particles 22, 24 will again reach the brush 12 and get launched again. In this way the particles 22, 24 bounce forth and back between the brush 12 and the squeegee 32 in an more or less zigzag-wise manner after they are finally ingested by the vacuum aggregate 38. Some of the dirt and/or liquid particles 22, 24 will however get launched from the surface 20 in such a flat manner that they will be resprayed back onto the surface 20 in the area between the brush 12 and the squeegee 32. Since the squeegee 32 acts as a kind of wiper, these particles 22, 24 will not get launched out of the nozzle housing 28 again. Due to the under-pressure that is applied by the vacuum aggregate 38 these re-sprayed particles 22, 24 will then also be ingested by the vacuum aggregate 38.

The squeegee element 32 is adapted to flex/flip around its longitudinal direction 48 between an open and a closed position depending on the movement direction 40 of the nozzle 10. It thereto comprises a flexible rubber lip 46 that is preferably made of polyurethane. The rubber lip 46 is at its fixed end 31 fixed to the bottom side 30 of the housing 28 (see e.g. FIGS. 5 and 6).

In order to guarantee good cleaning results in a backward stroke of the nozzle 10 (shown in FIG. 1) as well as in a forward stroke of the nozzle 10 (shown in FIG. 2), the squeegee 32 furthermore comprises a plurality of protrusions 50 for switching the squeegee 32 from the open to the closed position and vice versa, depending on the direction of movement 40 of the nozzle 10. These protrusions 50 are arranged at or near a free end 33 of the rubber lip 46 that during use is intended to touch the floor 20 (see e.g. FIGS. 5 and 6). More specifically, the protrusions 50 are arranged at or near the free end 33 of the rubber lip 46 on a backside 35 of the rubber lip 46 that faces away from the rotating brush 12. The protrusions 50 protrude from said backside 35 of the rubber lip 46. The protrusions 50 are herein also referred to as studs 50.

If the nozzle 10 is moved in a forward stroke (shown in FIG. 2), where the squeegee is, seen in the direction of movement 40, located behind the rotating brush 12, the squeegee 32 is arranged in a closed position. In this closed position the squeegee 32 is adapted to push or wipe dirt and/or liquid particles 22, 24 across or off the surface 20 by more or less gliding over the surface 20. In such a forward stroke the squeegee 32 acts as a kind of wiper that collects the remaining water from the surface 20, which has not been lifted or has been sprayed back from the rotating brush 12 to the surface 20. The remaining water 24 which is collected by the squeegee can then be ingested by means of the applied under-pressure.

On the other hand, the squeegee 32 is arranged in its open position when the nozzle 10 is moved in a backward stroke (shown in FIG. 1), in which the squeegee 32 is, seen in the direction of movement 40 located in front of the rotating brush 12, so that it would encounter the dirt and/or liquid particles 22, 24 on the surface 20 before they would be encountered by the rotating brush 12. In this backward stroke the studs 50 flip the squeegee 32 to its open position. In this open position dirt and/or liquid particles 22, 24 can then enter into the suction inlet 36 through openings 44 that are created between the studs 50, the rubber lip 46 and the surface to be cleaned 20 (see e.g. FIG. 6*a*).

If the squeegee 32 was not able to switch to that open position in the backward stroke, only very small dirt particles 22 would be able to reach the suction inlet 36, while most of the dirt and/or liquid particles 22, 24 would be entangled by the squeegee 32 and pushed across the surface 20 without being able to enter the suction inlet 36. This would of course result in a poor cleaning and drying effect.

Figure 2:
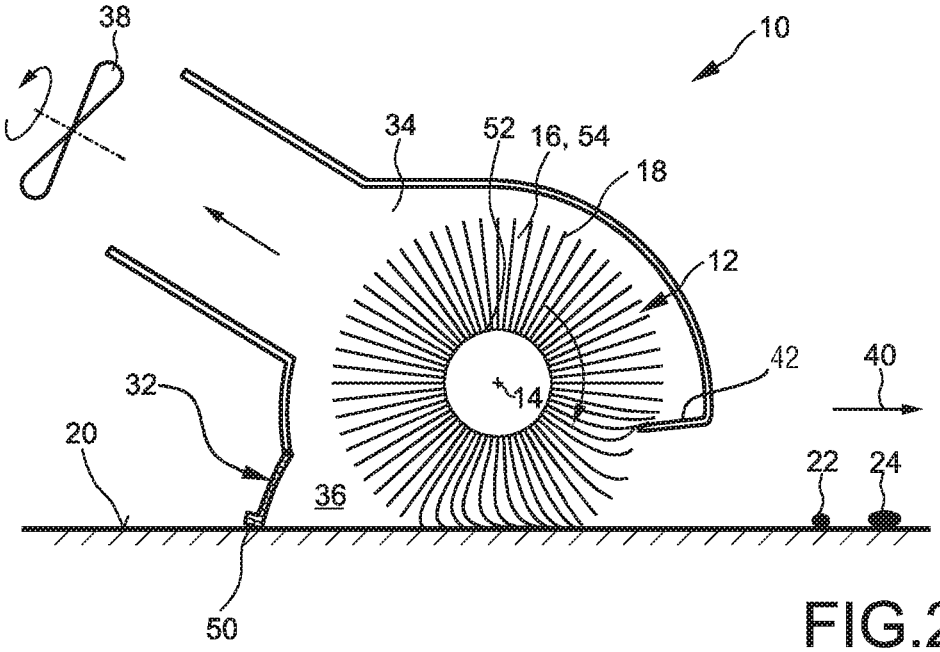
FIG. 2 shows a schematic cross-section of the first embodiment of the nozzle arrangement shown in FIG. 1 in a second working position.
Figure 3:
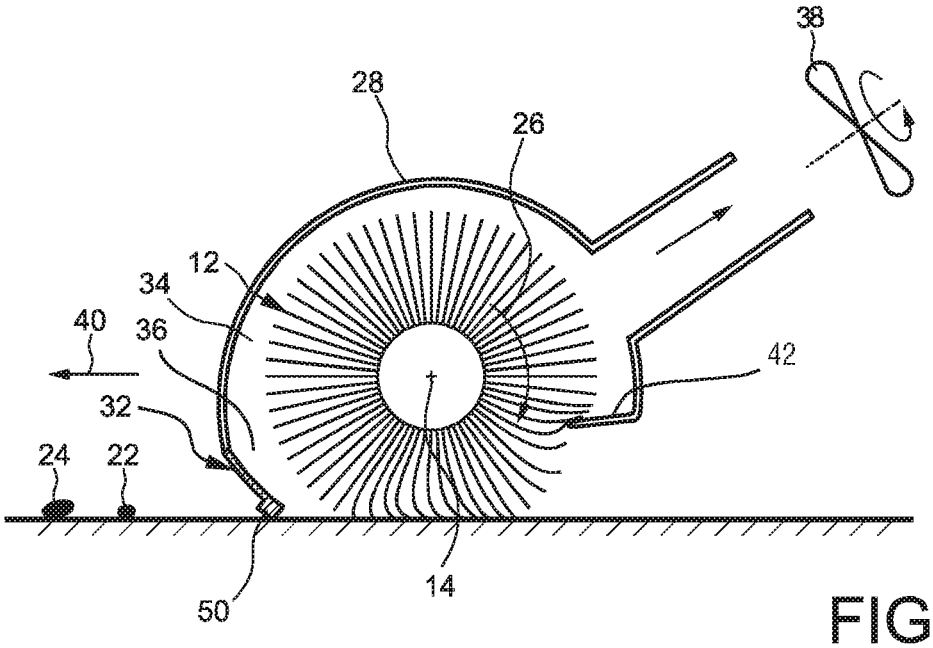
FIG. 3 shows a schematic cross-section of a second embodiment of the nozzle arrangement of the cleaning device according to the present invention in a first working position.
Figure 4:
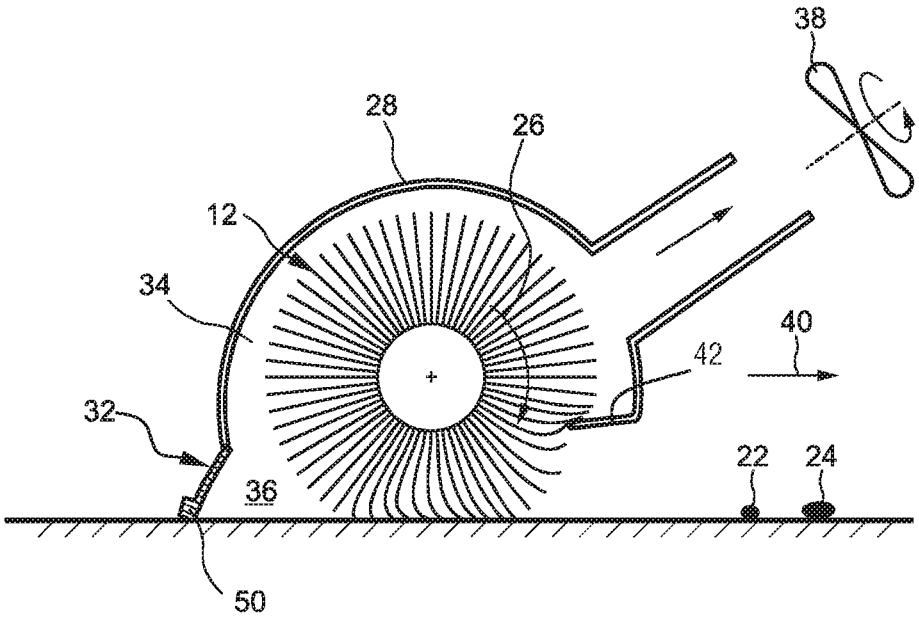
FIG. 4 shows a schematic cross-section of the second embodiment of the nozzle arrangement shown in FIG. 3 in a second working position.

FIGS. 3 and 4 show a second embodiment of the nozzle arrangement 10. These figures illustrate that the nozzle housing 28 may also have another form. The squeegee 32 can also be arranged at the front end of the nozzle housing 28, instead of being arranged at its back end as shown in FIGS. 1 and 2. However, by comparing FIGS. 3 and 4 with FIGS. 1 and 2 it can be seen that the squeegee 32 is still arranged on the side of the brush 12, where the brush elements 16 enter the nozzle housing 28 during the brush's rotation (see rotation direction 26).

As it can be seen from FIG. 3, the squeegee 32 has to be in this case again in the open position when the nozzle 10 is moved in the forward direction, in which the squeegee 32 is, seen in the direction of movement 40, located in front of the rotating brush 12.

On the other hand, the squeegee 32 needs to be in its closed position when the nozzle is according to this embodiment moved in the backward direction as shown in FIG. 4, where the rotating brush 12 is, seen in the movement direction 40, located in front of the squeegee 32 and encounters the dirt and/or liquid particles 22, 24 first.

Figure 5A:
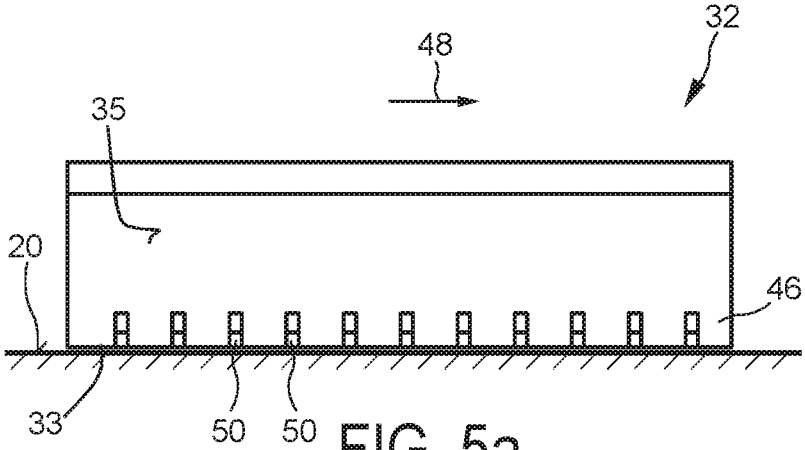
FIG. 5 shows a schematic top view (FIG. 5*a*) and a schematic cross-section (FIG. 5*b*) of a squeegee element of the nozzle arrangement according to the present invention in a first working position.
Figure 5B:
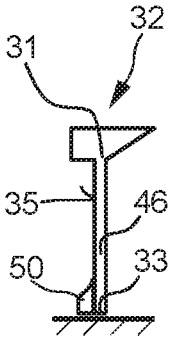
Figure 6A:
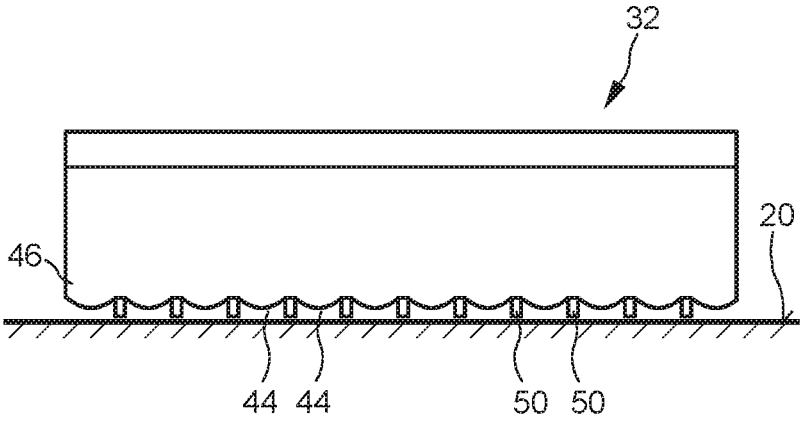
FIG. 6 shows a schematic top view (FIG. 6*a*) and a schematic cross-section (FIG. 6*b*) of the squeegee element shown in FIG. 5 in a second working position.
Figure 6B:
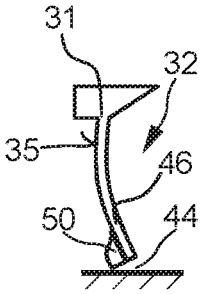

Enlarged schematic views of the squeegee 32 are shown in FIGS. 5 and 6. FIGS. 5*a, b* show the squeegee 32 in its closed position, whereas FIGS. 6*a, b* show the squeegee 32 in its open position.

The studs 50 that are arranged near the free end 33 of the rubber lip 46, where the squeegee 32 is intended to touch the surface 20, are adapted to at least partly lift the rubber lip 46 from the surface 20, when the nozzle 10 is moved on the surface 20 in the backward direction 40 (as shown e.g. in FIG. 1). In this case the rubber lip 46 is bent and at least partly lifted, which is mainly due to the natural friction which occurs between the surface 20 and the studs 50. The studs 50 then act as a kind of stopper that decelerate the rubber lip 46 and forces it to flip over the studs 50. The squeegee 32 is thereby forced to glide on the studs 50, wherein the rubber lip 46 is lifted by the studs 50 and openings 44 occur in the space between the rubber lip 46 and the surface 20 (see FIGS. 6*a, b*).

A further feature of the nozzle arrangement 10 according to the present invention may be seen in FIGS. 1 to 4. The nozzle 10 may also comprise a spoiler 42. The spoiler 42 is arranged on a second longitudinal side 29 of the rotating brush 12 in the area where the brush elements 16 leave the nozzle housing 28 during the brush's rotation. This spoiler 42 contacts the rotating brush 12 and deflects the brush elements 16 during the rotation of the brush 12. The spoiler 42 projects from an interior of the nozzle housing 28 towards the rotating brush 12.

The spoiler 42 has the function to prevent an unwanted blowing effect of the brush 12 at the second longitudinal side 29 of the rotating brush 12. Without said spoiler 42 the brush 12 would act as a kind of gear pump which pumps air from the inside of the nozzle housing 28 to the outside. This blowing effect would cause dirt and/or liquid particles 22, 24 to be blown away, so that they could not be encountered anymore by the rotating brush 12. The spoiler 42 is configured to press the brush elements 16 together and to bend them as soon as they hit against the spoiler 42. In this way air, which is present in the space between the brush elements 16, is pushed out of said space. The unwanted blowing effect of the rotating brush 12 may thereby be prevented in an efficient way.

The spoiler 42 also at least partly restricts air from getting sucked into the nozzle housing 28 at the second longitudinal side 29 of the brush 12. The spoiler 42 therefore also serves as a flow equalizer. It facilitates a constant flow rate of air entering the second longitudinal side 29 of the nozzle housing 28. This constant flow rate is especially important, since the squeegee element 32 flips depending on the movement direction 40 of the nozzle 10 between an open and a closed position and thereby causes a different flow rate depending on the movement direction 40 of the nozzle 10.

Figure 11:
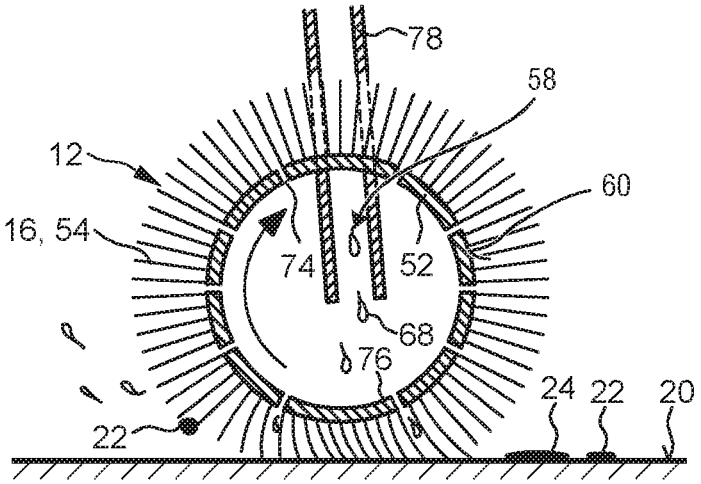
FIG. 11 shows a schematic cross-section of an embodiment of a rotating brush of the cleaning device.

As illustrated in FIG. 11 the nozzle arrangement 10 further comprises a liquid supplying arrangement 58 which is configured to supply a cleansing liquid 68 to the rotating brush 12. The liquid supplying arrangement 58 preferably comprises a hose 78 that is connected to the core element 52 of the rotating brush 12 for supplying the cleansing liquid 68 into the interior of the core element 52. The core element 52 is preferably realized as a hollow cylinder. The cylindrical core element preferably comprises a plurality of openings 74 that extend through the cylindrical wall 76 of the core element 52. The exterior surface 60 of the cylindrical wall 76 is herein also denoted as circumferential surface 60 of the core element 52.

The cleansing liquid 68 may be supplied to the hollow core element 52, wherein, during the rotation of the rotating brush 12, the cleansing liquid 68 leaves the hollow core 52 via the plurality of openings 74. The brush elements 16 are thereby wetted. In this way, the cleansing liquid 68 also drizzles or falls on the surface 20 to be cleaned. The surface 20 is thereby wetted as well with the cleansing liquid 68. This especially enhances the adherence of the dirt particles 22 to the brush element 16 and therefore improves the ability to remove stains from the surface 20.

Due to the high rotational speeds with which the rotating brush 12 is driven the cleansing liquid 68 will spray out of the openings 74 in the form of a cloud of mist. This serves for a very uniform distribution of the cleansing liquid 68 over the length of the rotating brush 12.

Figure 8:
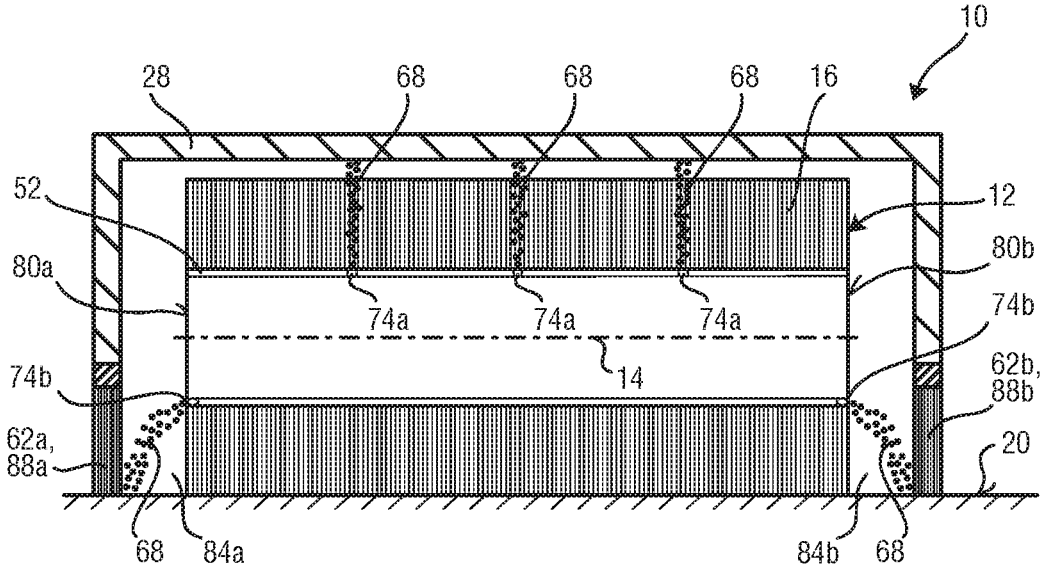
FIG. 8 shows a further cross-sectional view of the nozzle arrangement.

In contrast to state of the art wet cleaning appliances the cleansing liquid 68 is however not only supplied radially outwards from the cylindrical core element 52 but also out of the transverse sides 80*a, b* (short sides of the core element 52) as illustrated in FIG. 8. These transverse sides 80*a, b* denote the base sides of the cylindrical core element 52 that are arranged perpendicular to the circumferential surface 60 of the core element 52. The core element 52 preferably comprises a plurality of first openings 74*a*, which are arranged on the circumferential surface 60, and at least one second opening 74*b* on or near each transverse side 80*a, b* of the core element 52 (see FIG. 8). "Near each transverse side 80*a, b* of the core element 52" in this case means that the at least one second opening 74*b* does not necessarily need be arranged on the transverse sides 80*a, b* of the core element 52, but may be also arranged on the circumferential surface 60 of the core element 52 close to said transverse sides 80*a, b*. A distance between the second opening 74*b* and one of the transverse sides 80*a,b* of the core element 52 is chosen to be preferably less than 10 mm, more preferably less than 5 mm.

Supplying the cleansing liquid 68 also to the transverse sides 80*a, b* of the rotating brush 12 enables to wet the floor 20 over the whole width of the nozzle 10. Especially when cleaning corners or cleaning along plinths, this has shown to be a major advantage. Most of the prior art wet cleaning devices do not enable to wet the floor over the whole width of the nozzle. The reason for that is that cleansing liquid is usually only supplied to the rotating brush, such that the cleaned and wetted area on the floor is determined by the length of the rotating brush. Since the nozzle housing is in most of the prior art devices larger than the rotating brush, the wetted/cleaned area is in all of these cases smaller than the nozzle housing. During use of such devices there will be thus always a small strip left over on the lateral sides of the nozzle housing which is not wetted.

This problem is solved according to the present invention by spraying the cleansing liquid 68 also to the transverse sides 80*a, b* of the rotating brush 12. This enables a continuous wetness distribution over the whole width of the nozzle 10, without the occurrence of any non-wetted stripes.

Figure 7:
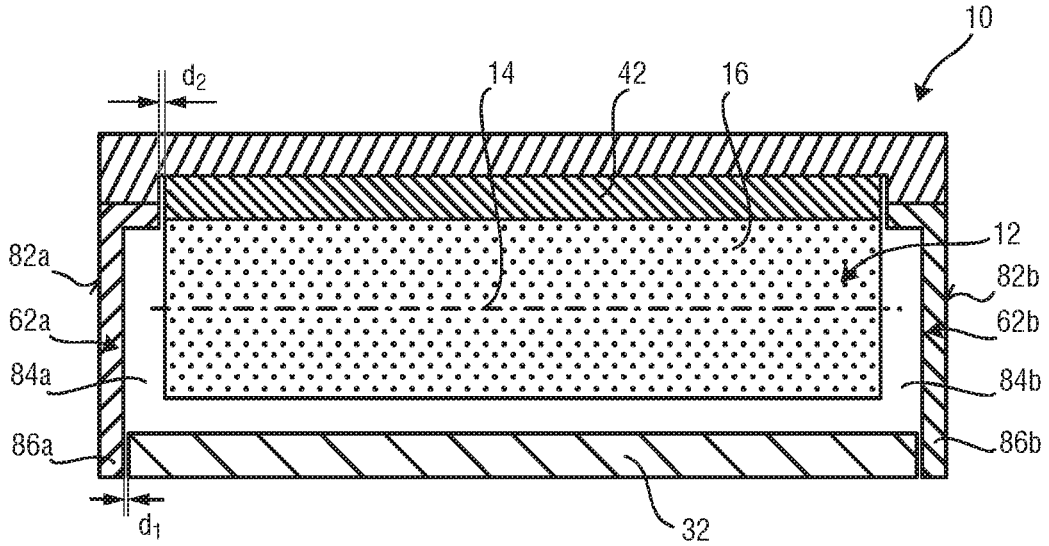
FIG. 7 shows a top view of the nozzle arrangement from below.

FIGS. 7 and 8 show the nozzle arrangement 10 in a top view from the bottom side of the nozzle 10 (FIG. 7) and in a cross-sectional view (FIG. 8) that is perpendicular to the cross-sections shown in FIGS. 1 to 4.

As it can be seen in these figures two side sealing elements, a first side sealing element 62*a* and a second side sealing element 62*b*, are arranged on the lateral sides 82*a, b* (short sides) of the nozzle housing 28. These side sealing elements 62*a, b* are configured to seal the lateral sides 82*a, b* of the nozzle housing 28. The side sealing elements 62*a, b* on the one hand prevent an air leakage on the lateral sides 82*a, b* of the nozzle housing 28 that could impede the under-pressure which is generated by the vacuum aggregate 38. Such an air leakage would produce an airstream that is oriented substantially perpendicular to the transverse sides 80*a, b* of the core element 52 (i.e. along the longitudinal direction 48). Without the at least one side sealing element 62*a, b* cleansing liquid 68, which is sprayed to the lateral sides of the rotating brush 12, would maybe not even reach the floor 20, but get forced inwards into the nozzle 10 towards the rotating brush 12 by means of the resulting airstream. On the other hand these side sealing elements 62*a, b* prevent the cleansing liquid 68 from getting sprayed out of the lateral sides 82*a, b* of the nozzle housing 28.

The first side sealing element 62*a* is spaced apart from the first transverse side 80*a* of the core element 52, such that a gap 84*a* (herein denoted as first gap) is defined between the first transverse side 80*a* of the core element 52 and the first side sealing element 62*a*. Similarly is the second side sealing element 62*b* spaced apart from the second transverse side 80*b* of the core element 52, such that on the opposite side a similar gap 84*b* (herein denoted as second gap) occurs between the second transverse side 80*b* of the core element 52 and the second side sealing element 62*b*. The cleansing liquid 68 is sprayed into the gaps 84*a, b* through the above-mentioned second openings 74*b* that are provided on the transverse sides 80*a, b* of the core element 52.

A first part 86*a, b* of each of the two side sealing elements 62*a, b* is preferably arranged substantially perpendicular to the brush axis 14, i.e. parallel to the transverse sides 80*a, b* of the rotating brush 12 (see FIG. 7). Instead of having an L-shaped cross-section as illustrated in FIG. 7, the side sealing elements 62*a, b* may however also have a straight cross-section and be inclined with respect to the brush axis 14.

In order to seal the whole lateral sides 82*a, b* of the nozzle housing 28 each of the side sealing elements 62*a, b* preferably at least extends between the squeegee 32 and the point where the spoiler 42 contacts the rotating brush 12 (see FIG. 7). The length of each of the two side sealing elements 62*a, b* is in other words at least equal to or larger than the distance between the squeegee 32 and the contact point of the spoiler 42 with the rotating brush 12. Since the squeegee 32 is configured to flex depending on the movement direction 40 from its open position to its close position (and vice versa), the side sealing elements 62*a, b* preferably extend at least from the contact point of the spoiler 42 with the rotating brush 12 to a section of the squeegee 32 which has in the closed position of the squeegee 32 the maximum distance to the spoiler 42. Said section of the squeegee 32 is usually the free end 33 of the squeegee (in the closed position). In this way, the side sealing elements 62*a, b* cover the whole lateral sides 82*a, b* of the nozzle housing 28 independent of the position of the squeegee 32 (open or close position). According to an alternative embodiment (not shown) the squeegee 32 may extend over the full width of the nozzle housing 28 and thus be arranged behind the two side sealing elements 62*a, b* (In FIG. 7 seen below the side sealing elements 62*a, b*).

The side sealing elements 62*a, b* may touch the lateral sides of the spoiler 42 and the squeegee 32. A contact between the side sealing elements 62*a, b* and the spoiler 42 or the squeegee 32 could however impede the function of the spoiler 42 or the squeegee 32, respectively. On the other hand, there should not be a too large gap between the side sealing elements 62*a, b* and the spoiler 42 or the squeegee 32, respectively, since this would create a too large air leakage that could then impede the under-pressure that is generated within the nozzle housing 28.

It is therefore preferred that a distance $d_1$ between the first part 86*a, b* of the side sealing elements 62*a, b* and the respective lateral sides of the squeegee 32 is smaller than 5 mm, preferably smaller than 2 mm. It is also preferred that a distance $d_2$ between the side sealing elements 62*a, b* and the respective lateral sides of the spoiler 42 is smaller than 5 mm, preferably smaller than 3 mm.

Different materials are generally conceivable for the side sealing elements 62*a, b*. Exemplary materials are rubber and plastic. It has however shown that the function of the side sealing elements 62*a, b* may be improved if these side sealing elements 62*a, b* are realized as brushes 88*a, b* (see e.g. FIGS. 8 and 9). These brushes 88*a, b* (herein denoted as fixed or side brushes 88*a, b*) may be made from thin fibers. Each brush 88*a, b* preferably comprises a plurality of bristles 90 that are made of synthetic or animal hair. Hydrophilic materials, like polyamide, are especially preferred. Said bristles 90 preferably have a diameter of less than 0.8 mm, even more preferably of less than 0.3 mm.

Such brushes 88*a, b* have shown a sealing effect that is sufficient to seal the lateral sides 82*a, b* of the nozzle housing 28. In contrast to a rubber or plastic lip these brushes 88*a, b* have a significant advantage. Since some of the cleansing liquid 68 is sprayed into the gaps 84*a, b*, a small amount of cleansing liquid 68 will also reach the side brushes 88*a, b*.

Due to capillary effects these amounts of cleansing liquid 68 may enter the side brushes 88*a, b* and get adhered at the bristles 90. By leaving the bristles 90 towards the floor a small amount of cleansing liquid 68 will also be supplied to the floor 20 under the side brushes 88*a, b*. This small amount of cleansing liquid 68 shows on the floor a nice fading between the wet area inside the nozzle housing 28 and the dry area outside the nozzle housing 28. Stripes, as they occur when using a rubber or plastic side sealing element 62*a, b*, do not occur on the floor 20.

A further advantage of the usage of brushes 88*a, b* as side sealing elements 62*a, b* is their self-cleaning effect. As explained above, a constant amount of cleansing liquid 68 will get adhered to the bristles 90. Due to the applied under-pressure within the nozzle housing 28 an air flow occurs in-between the bristles 90 that sucks some cleansing liquid 68 out of the brushes 88*a, b* again. This sucked-out cleansing liquid 68 will also pull out dirt particles 22 that adhere to the bristles 90 of the side brushes 88*a, b*.

A further positive effect of the usage of such brushes 88*a, b* as side sealing elements 62*a, b* is the scrubbing and cleaning behavior of such brushes 88*a, b*. The brushes 88*a, b* will also brush the floor 20 with cleansing liquid 68 in order to remove stains on the floor 20.

Figure 9:
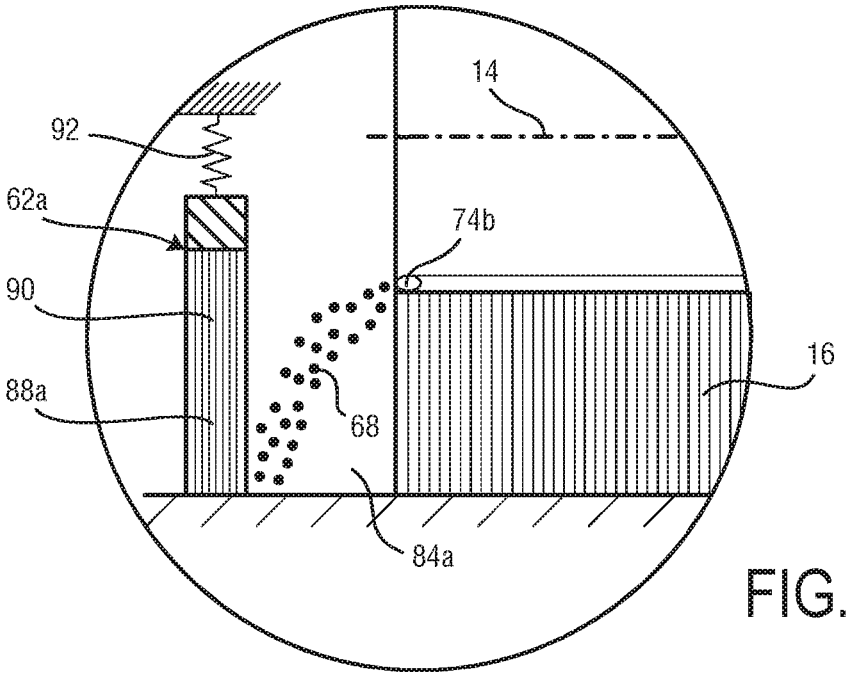
FIG. 9 shows an enlarged schematic view of FIG. 8.

A still further feature of the nozzle arrangement 10 according to the present invention may be seen in FIG. 9. Since it is preferred that the side sealing elements 62*a, b* constantly touch the surface to be cleaned 20, the side sealing elements 62*a, b* may be spring-loaded by means of a spring element 92. In this case it is ensured that the side sealing elements 62*a, b* are pressed onto the floor 20 with an almost constant pressure, even if an unevenness occurs on the floor 20.

The above-mentioned arrangement in summary enables to wet the floor 20 over the whole width of the nozzle 10. In order to receive a fairly uniform distribution of the cleansing liquid 68 on the floor 20, the openings 74*a, b* are preferred to be equally distributed over the core element 52 of the rotating brush 12. In a preferred embodiment of the present invention the total flow rate per minute that leaves through all of the first openings 74*a* together is at maximum 60 ml per minute. In order to spray an equal amount of cleansing liquid 68 into the gaps 84*a, b*, the cleansing liquid 68 preferably leaves each of the second openings 74*b* at a maximum flow rate of 10 ml per minute. A maximum flow rate of 30 ml per minute through the first openings 74*a* and of 5 ml per minute through each of the second openings 74*b* is even more preferred.

In the following, further properties of the rotating brush 12 and the rotational speed with which the brush 12 is driven shall be presented. The rotating brush 12 preferably has a diameter which is in a range of 20 to 80 mm, and the driving may be capable of rotating the brush 12 at an angular velocity which is at least 3,000 revolutions per minute, preferably at an angular velocity around 6,000 rpm and above. A width of the rotating brush 12, i.e. a dimension of the brush 12 in a direction in which the rotation axis 14 of the rotating brush 12 is extending, may be in an order of 25 cm, for example.

On an exterior surface of the core element 52 of the rotating brush 12, tufts 54 are provided. Each tuft 54 comprises hundreds of fiber elements, which are referred to as brush elements 16. For example, the brush elements 16 are made of polyester or nylon with a diameter in an order of about 10 micrometers, and with a Dtex value which is lower than 150 g per 10 km. A packing density of the brush elements 16 may be at least 30 tufts 54 per $cm^2$ on the exterior surface of the core element 52 of the brush 12.

The brush elements 16 may be arranged rather chaotically, i.e. not at fixed mutual distances. Furthermore, it shall be noted that an exterior surface 56 of the brush elements 16 may be uneven, which enhances the capability of the brush elements 16 to catch liquid droplets 24 and dirt particles 22. In particular, the brush elements 16 may be so-called micro-fibers, which do not have a smooth and more or less circular circumference, but which have a rugged and more or less star-shaped circumference with notches and grooves. The brush elements 16 do not need to be identical, but preferably the linear mass density of a majority of a total number of the brush elements 16 of the rotating brush 12 meets the requirement of being lower than 150 g per 10 km, at least at tip portions 18.

By means of the rotating brush 12, in particular by means of the brush elements 16 of the rotating brush 12, dirt particles 22 and liquid 24 are picked up from the surface 20, and are transported to a collecting position inside the cleaning device 100.

Due to the rotation of the brush 12, a moment occurs at which a first contact with the surface 20 is realized at a first position. The extent of contact is increased until the brush elements 16 are bent in such a way that the tip portions 18 of the brush elements 16 are in contact with the surface 20. The tip portions 18 as mentioned slide across the surface 20 and encounter dirt particles 22 and liquid 24 in the process, wherein an encounter may lead to a situation in which a quantity of liquid 24 and/or a dirt particles 22 are moved away from the surface 20 to be cleaned and are taken along by the brush elements 16 on the basis of adhesion forces. In the process, the brush elements 16 may act more or less like a whip for catching and dragging particles 22, 24, which is force-closed and capable of holding on to a particle 22, 24 on the basis of a functioning which is comparable to the functioning of a band brake. Furthermore, the liquid 24 which is picked up may pull a bit of liquid with it, wherein a line of liquid is left in the air, which is moving away from the surface 20. The occurring accelerations at the tip portions 18 of the brush elements 16 cause the dirt particles 22 and liquid droplets 24 to be automatically released from the rotating brush 12, when the brush elements loose contact from the floor 20 during their rotation. Since not all dirt particles 22 and liquid droplets 24 may be directly ingested by the vacuum aggregate 38, a small amount of dirt and liquid will be flung back onto the surface 20 in the area where the brush elements 16 loose the contact from the surface 20. However, this effect of re-spraying the surface 20 is overcome by the squeegee element 32 which collects this re-sprayed liquid and dirt by acting as kind of wiper (in the closed position, in the forward stroke), so that the remaining liquid 24 and dirt 22 may then be ingested due to the applied under-pressure. Therefore, only a small amount of liquid and dirt particles 22, 24 leaves the nozzle 10 behind the squeegee 32. As mentioned-above, said rest amount of water and dirt is similar to the amount of water and dirt that is left on the floor 20 by the rotating brush 12 if the nozzle 10 performs a backward stroke.

Due to the chosen technical parameters the brush elements 16 have a gentle scrubbing effect on the surface 20, which contributes to counteracting adhesion of liquid 24 and dirt particles 22 to the surface 20.

As the brush 12 rotates, the movement of the brush elements 16 over the surface 20 continues until a moment occurs at which contact is eventually lost. When there is no longer a situation of contact, the brush elements 16 are urged to assume an original, outstretched condition under the influence of centrifugal forces which are acting on the brush elements 16 as a result of the rotation of the brush 12. As the brush elements 16 are bent at the time that there is an urge to assume the outstretched condition again, an additional, outstretching acceleration is present at the tip portions 18 of the brush elements 16, wherein the brush elements 16 swish from the bent condition to the outstretched condition, wherein the movement of the brush elements 16 is comparable to a whip which is swished. The acceleration at the tip portions 18 at the time the brush elements 16 have almost assumed the outstretched condition again meets a requirement of being at least 3,000 $msec^2$.

Under the influence of the forces acting at the tip portions 18 of the brush elements 16, the quantities of dirt particles 22 and liquid 24 are expelled from the brush elements 16, as these forces are considerably higher than the adhesion forces. Hence, the liquid 24 and the dirt particles 22 are forced to fly away in a direction which faces away from the surface 20. The most part of the liquid 24 and the dirt particles 22 is then ingested by the vacuum aggregate. By means of the squeegee element 32 and the under-pressure generated in the suction area 34, as explained above, it is ensured that also most parts of the remaining liquid 24 and the dirt 22, that is sprayed back from the rotating brush 12 to the surface 20, is collected and then also ingested.

Under the influence of the acceleration, the liquid 24 may be expelled in small droplets. This is advantageous for further separation processes such as performed by the vacuum fan aggregate 38, in particular the centrifugal fan of the vacuum aggregate 38, which serves as a rotatable air-dirt separator. It is noted that suction forces such as the forces exerted by the centrifugal fan do not play a role in the above-described process of picking up liquid and dirt by means of brush elements 16. However, these suction forces are necessary for picking up the dirt and liquid that has been collected by the squeegee.

Besides the functioning of each of the brush elements 16, as described in the foregoing, another effect which contributes to the process of picking up dirt particles 22 and liquid 24 may occur, namely a capillary effect between the brush elements 16. In this respect, the rotating brush 12 with the brush elements 16 is comparable to a brush 12 which is dipped in a quantity of paint, wherein paint is absorbed by the brush 12 on the basis of capillary forces.

It appears from the foregoing that the rotating brush 12 according to the present invention has the following properties:

the soft tufts 54 with the flexible brush elements 16 will be stretched out by centrifugal forces during the contact-free part of a revolution of the brush 12;

it is possible to have a perfect fit between the brush 12 and the surface 20 to be cleaned, since the soft tufts 54 will bend whenever they touch the surface 20, and straighten out whenever possible under the influence of centrifugal forces;

the brush 12 constantly cleans itself, due to sufficiently high acceleration forces, which ensures a constant cleaning result;

heat generation between the surface 20 and the brush 12 is minimal, because of a very low bending stiffness of the tufts 54;

a very even pick-up of liquid from the surface 20 and a very even overall cleaning result can be realized, even if creases or dents are present in the surface 20, on the basis of the fact that the liquid 24 is picked up by the tufts 54 and not by an airflow as in many conventional devices; and dirt 22 is removed from the surface 20 in a gentle yet effective way, by means of the tufts 54, wherein a most efficient use of energy can be realized on the basis of the low stiffness of the brush elements 16.

On the basis of the relatively low value of the linear mass density, it may be so that the brush elements 16 have very low bending stiffness, and, when packed in tufts 54, are not capable of remaining in their original shape. In conventional brushes, the brush elements spring back once released. However, the brush elements 16 having the very low bending stiffness as mentioned will not do that, since the elastic forces are so small that they cannot exceed internal friction forces which are present between the individual brush elements 16. Hence, the tufts 54 will remain crushed after deformation, and will only stretch out when the brush 12 is rotating.

In comparison with conventional devices comprising hard brushes (agitators) for contacting a surface to be cleaned, the brush 12 which is used according to the present invention is capable of realizing cleaning results which are significantly better, due to the working principle according to which brush elements 16 are used for picking up liquid 24 and dirt 22 and taking the liquid 24 and the dirt 22 away from the surface 20 to be cleaned, wherein the liquid 24 and the dirt 22 are flung away by the brush elements 16 before they contact the surface 20 again in a next round. The microfiber hairs that are used as brush elements 16 also have the advantage that the hairs serve as a flow restriction when passing the restriction element 27. The brush 12 therefore shows a very good sealing effect. Stiff hairs of an agitator or adjutator could instead not do so.

Figure 10:
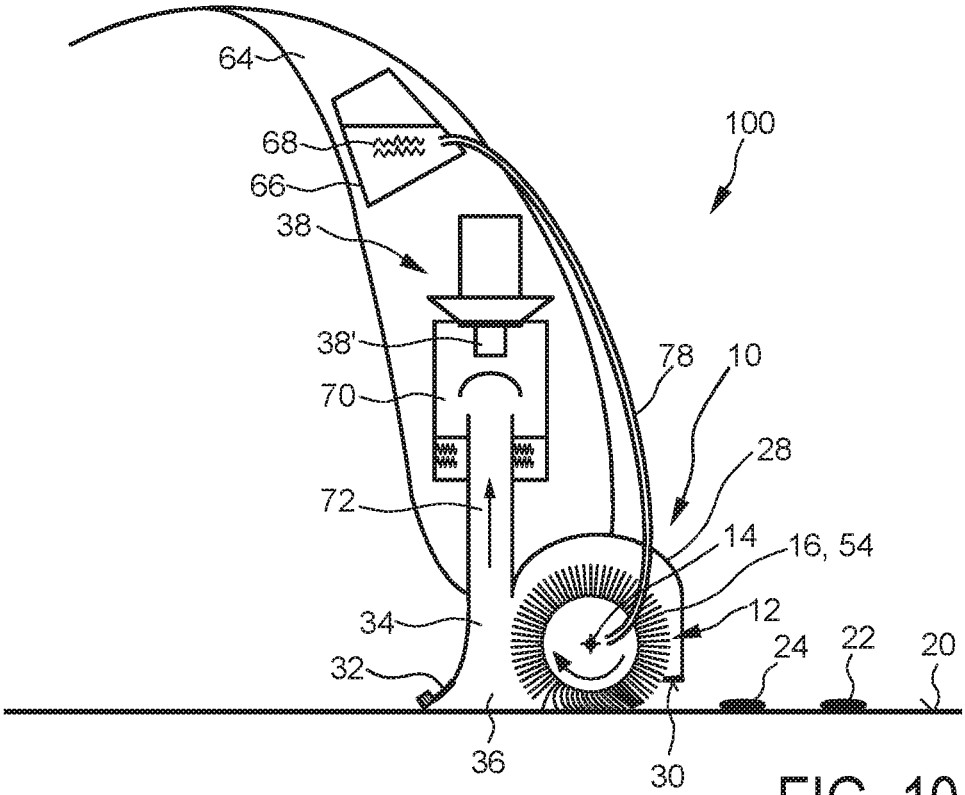
FIG. 10 shows a schematic cross-section of the cleaning device according to the present invention in its entirety.

FIG. 10 provides a view of the cleaning device 100 according to the present invention in its entirety. According to this schematic arrangement the cleaning device 100 comprises a nozzle 10 with a nozzle housing 28 in which the rotating brush 12 is rotatably mounted on the brush axis 14. A drive, which can be realized being a regular motor, such as e.g. an electro motor (not shown), is preferably connected to or even located on the brush axis 14 for the purpose of driving the brush 12 in rotation. It is noted that the motor may also be located at any other suitable position within the cleaning device 100.

In the nozzle housing 28, means such as wheels (not shown) are arranged for keeping the rotation axis 14 of the brush 12 at a predetermined distance from the surface 20 to be cleaned.

As already explained above, the squeegee element 32 is preferably spaced apart from the brush 12 and attached to the bottom side 30 of the nozzle housing 28. In some embodiments the squeegee 32 may also be at least partly in contact with the brush 12. It extends substantially parallel to the brush axis 14, thereby defining a suction area 34 within the nozzle housing 28 in between the squeegee element 32 and the brush 12, which suction area 34 has a suction inlet 36 which is located at the bottom side 30 of the nozzle housing 28 facing the surface 20 to be cleaned.

The cleaning device 100 is furthermore preferably provided with the following components:

a handle 64 which allows for easy manipulation of the cleaning device 100 by a user;

the reservoir 66 for containing the cleansing liquid 68 such as water;

a debris collecting container 70 for receiving liquid 24 and dirt particles 22 picked up from the surface 20 to be cleaned;

a flow channel in the form of, for example, a hollow tube 72, connecting the debris collecting container 70 to the suction area 34, which suction area 34 constitutes the suction inlet 36 on the bottom side 30 of the nozzle 10. It has to be noted that, in the meaning of the present invention the flow channel including the hollow tube 72 may also be denoted as suction area 34 in which the above mentioned underpressure is applied by the vacuum aggregate 38; and the vacuum fan aggregate 38 comprising a centrifugal fan 38', arranged at a side of the debris collecting chamber 70 which is opposite to the side where the tube 72 is arranged.

For sake of completeness, it is noted that within the scope of the present invention, other and/or additional constructional details are possible. For example, an element may be provided for deflecting the debris 22, 24 that is flung upwards, so that the debris 22, 24 first undergoes a deflection before it eventually reaches the debris collecting chamber 70. Also, the vacuum fan aggregate 38 may be arranged at another side of the debris collecting chamber 70 than the side which is opposite to the side where the tube 72 is arranged.

The technical parameters of the rotating brush 12, the brush elements 16 and the drive result from experiments which have been performed in the context of the present invention.

In the following, one of the experiments and the results of the experiment will be described. The tested brushes were equipped with different types of fiber materials used for the brush elements 16, including relatively thick fibers and relatively thin fibers. Furthermore, the packing density as well as the Dtex values have been varied. The particulars of the various brushes are given in the following table.

| | packing density (# tufts/ $cm^2$) | fibers per tuft | Dtex value (g/10 km) | fiber material | fiber length (mm) | fiber appearance |
|---|---|---|---|---|---|---|
| brush 1 | 160 | 9 | 113.5 | nylon | 10 | springy, straight |
| brush 2 | 25 | 35 | 31.0 | nylon | 11 | fairly hard, curled |
| brush 3 | 40 | 90 | 16.1 | — | 11 | very soft, twined |
| brush 4 | 50 | 798 | 0.8 | polyester | 11 | very soft, twined |

The experiment includes rotating the brush under similar conditions and assessing cleaning results, wear, and power to the surface 20 subjected to treatment with the brush 12. This provides an indication of heat generation on the surface 20. The outcome of the experiment is reflected in the following table, wherein a mark 5 is used for indicating the best results, and lower marks are used for indicating poorer results.

| | stain removal | water pick-up | wear | power to the surface |
|---|---|---|---|---|
| Brush 1 | 5 | 3 | 3 | 3 |
| Brush 2 | 5 | 3 | 1 | 4 |
| Brush 3 | 5 | 4 | 4 | 5 |
| Brush 4 | 5 | 5 | 5 | 5 |

Among other things, the experiment proves that it is possible to have brush elements 16 with a linear mass density in a range of 100 to 150 g per 10 km, and to obtain useful cleaning results, although it appears that the water pick-up, the wear behavior and the power consumption are not so good. It is concluded that an appropriate limit value for the linear mass density is 150 g per 10 km. However, it is clear that with a much lower linear mass density, the cleaning results and all other results are very good. Therefore, it is preferred to apply lower limit values, such as 125 g per 10 km, 50 g per 10 km, 20 g per 10 km, or even 5 g per 10 km. With values in the latter order, it is ensured that cleaning results are excellent, water pick-up is optimal, wear is minimal, and power consumption and heat generation on the surface 20 are sufficiently low.

It is noted that the minimum value of 3,000 $msec^2$ in respect of the acceleration which is prevailing at tips 18 of the brush elements 16 during some time per revolution of the brush 12, in particular some time during a dirt release period, in which there is no contact between the brush elements 16 and the surface 20, is supported by results of experiments which have been performed in the context of the present invention.

In the following, one of the experiments and the results of the experiment will be described. The following conditions are applicable to the experiment:

1) A brush 12 having a diameter of 46 mm, a width of approximately 12 cm, and polyester brush elements 16 with a linear mass density of about 0.8 g per 10 km, arranged in tufts 54 of about 800 brush elements 16, with approximately 50 tufts 54 per $cm^2$, is mounted on a motor shaft.

2) The weight of the assembly of the brush 12 and the motor is determined.

3) The power supply of the motor is connected to a timer for stopping the motor after a period of operation of 1 second or a period of operation of 4 seconds.

4) The brush 12 is immersed in water, so that the brush 12 is completely saturated with the water. It is noted that the brush 12 which is used appears to be capable of absorbing a total weight of water of approximately 70 g.

5) The brush 12 is rotated at an angular velocity of 1,950 revolutions per minute, and is stopped after 1 second or 4 seconds.

6) The weight of the assembly of the brush 12 and the motor is determined, and the difference with respect to the dry weight, which is determined under step 2), is calculated.

7) Steps 4) to 6) are repeated for other values of the angular velocity, in particular the values as indicated in the following table, which further contains values of the weight of the water still present in the rotating brush 12 at the stops after 1 second and 4 seconds, and values of the associated centrifugal acceleration, which can be calculated according to the following equation:

$$a=(2*\pi*f)^2*R$$

in which:

a=centrifugal acceleration ($m/s^2$)

f=brush frequency (Hz)

R=radius of the brush 12 (m)

| angular velocity (rpm) | weight of water present after 1 s (g) | weight of water present after 4 s (g) | centrifugal acceleration ($m/s^2$) |
|---|---|---|---|
| 1,950 | 8.27 | 7.50 | 959 |
| 2,480 | 5.70 | 4.57 | 1,551 |
| 3,080 | 3.70 | 3.11 | 2,393 |
| 4,280 | 2.52 | 1.97 | 4,620 |
| 5,540 | 1.95 | 1.35 | 7,741 |
| 6,830 | 1.72 | 1.14 | 11,765 |
| 7,910 | 1.48 | 1.00 | 15,780 |
| 9,140 | 1.34 | 0.94 | 21,069 |

Figure 12:
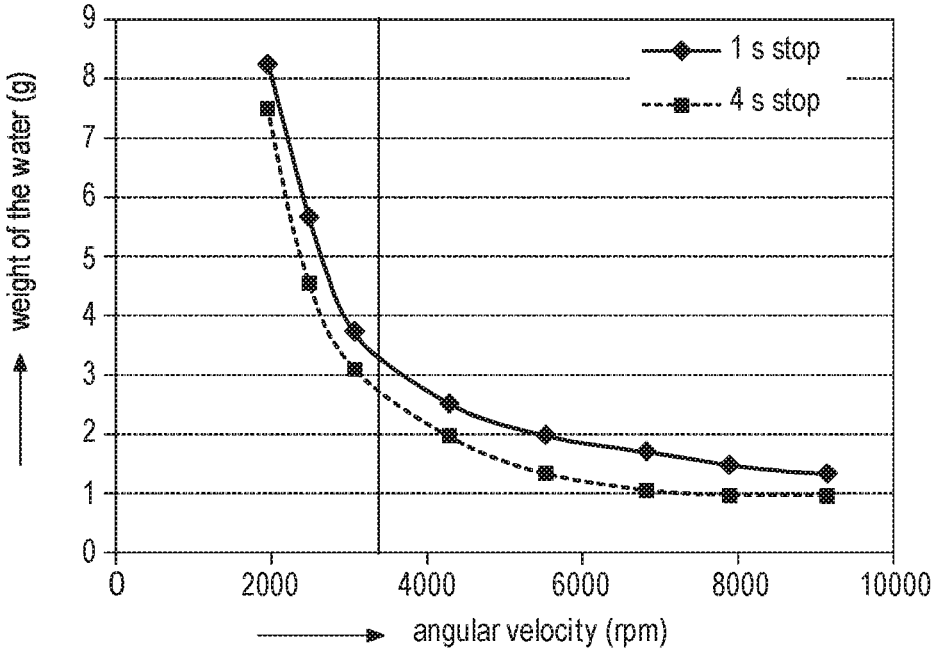
FIG. 12 shows a graph which serves for illustrating a relation between an angular velocity of a rotating brush and a self-cleaning capacity of said rotating brush.
Figure 13:
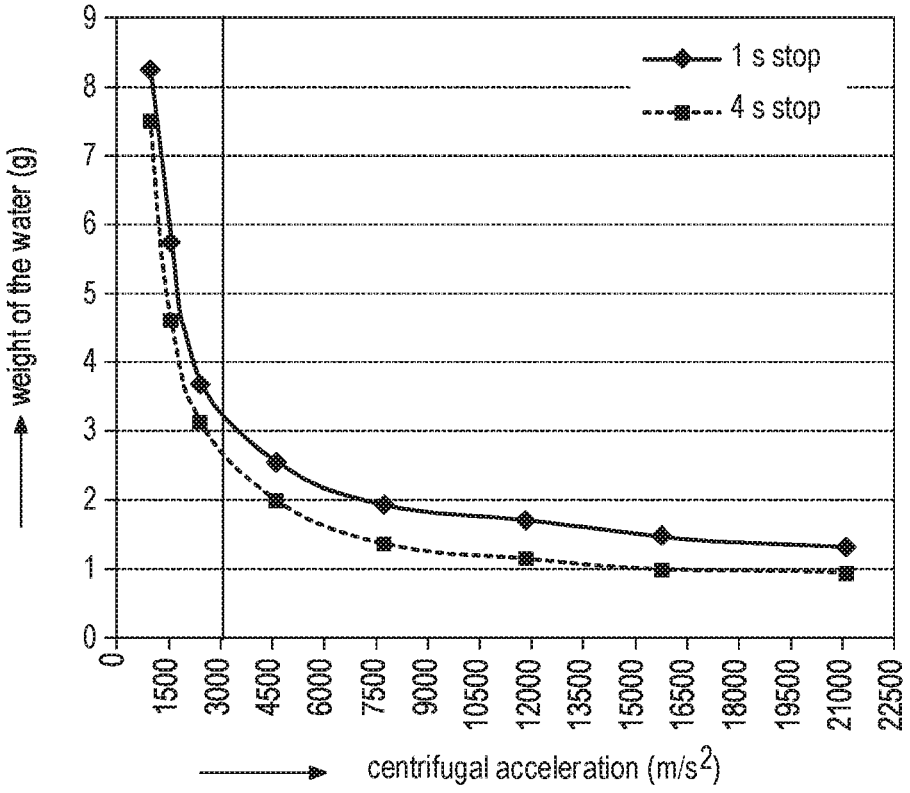
FIG. 13 shows a graph which serves for illustrating a relation between a centrifugal acceleration of a rotating brush and a self-cleaning capacity of said rotating brush.

The relation which is found between the angular velocity and the weight of the water for the two different stops is depicted in the graph of FIG. 12, and the relation which is found between the centrifugal acceleration and the weight of the water for the two different stops is depicted in the graph of FIG. 13, wherein the weight of the water is indicated at the vertical axis of each of the graphs. It appears from the graph of FIG. 12 that the release of water by the rotating brush 12 strongly decreases, when the angular velocity is lower than about 4,000 rpm. Also, it seems to be rather stable at angular velocities which are higher than 6,000 rpm to 7,000 rpm.

A transition in the release of water by the rotating brush 12 can be found at an angular velocity of 3,500 rpm, which corresponds to a centrifugal acceleration of 3,090 $ms^2$. For sake of illustration of this fact, the graphs of FIGS. 12 and 13 contain a vertical line indicating the values of 3,500 rpm and 3,090 $ms^2$, respectively.

On the basis of the results of the experiment as explained in the foregoing, it may be concluded that a value of 3,000 $ms^2$ in respect of an acceleration at tips 18 of the brush elements 16 during a contact-free period is a realistic minimum value as far as the self-cleaning capacity of brush elements 16 which meet the requirement of having a linear mass density which is lower than 150 g per 10 km, at least at tip portions 18, is concerned. A proper performance of the self-cleaning function is important for obtaining good cleaning results, as has already been explained in the foregoing.

For sake of completeness, it is noted that in the cleaning device 100 according to the present invention, the centrifugal acceleration may be lower than 3,000 $ms^2$. The reason is that the acceleration which occurs at tips 18 of the brush elements 16 when the brush elements 16 are straightened out can be expected to be higher than the normal centrifugal acceleration. The experiment shows that a minimum value of 3,000 $ms^2$ is valid in respect of an acceleration, which is the normal, centrifugal acceleration in the case of the experiment, and which can be the higher acceleration which is caused by the specific behavior of the brush elements 16 when the dirt pick-up period has passed and there is room for straightening out in an actual cleaning device 100 according to the present invention, which leaves a possibility for the normal, centrifugal acceleration during the other periods of the rotation (e.g. the dirt pick-up period) to be lower.

It will be clear to a person skilled in the art that the scope of the present invention is not limited to the examples discussed in the foregoing, but that several amendments and modifications thereof are possible without deviating from the scope of the present invention as defined in the attached claims. While the present invention has been illustrated and described in detail in the figures and the description, such illustration and description are to be considered illustrative or exemplary only, and not restrictive. The present invention is not limited to the disclosed embodiments.

For sake of clarity, it is noted that a fully outstretched condition of the brush elements 16 is a condition in which the brush elements 16 are fully extending in a radial direction with respect to a rotation axis 14 of the rotating brush 12, wherein there is no bent tip portion in the brush elements 16. This condition can be realized when the rotating brush 12 is rotating at a normal operative speed, which is a speed at which the acceleration of 3,000 $msec^2$ at the tips 18 of the brush elements 16 can be realized. It is possible for only a portion of the brush elements 16 of the rotating brush 12 to be in the fully outstretched condition, while another portion is not, due to obstructions which are encountered by the brush elements 16. Normally, the diameter D of the rotating brush 12 is determined with all of the brush elements 16 in the fully outstretched condition.

The tip portions 18 of the brush elements 16 are outer portions of the brush elements 16 as seen in the radial direction, i.e. portions which are the most remote from the rotation axis 14. In particular, the tip portions 18 are the portions which are used for picking up dirt particles 22 and liquid, and which are made to slide along the surface 20 to be cleaned. In case the rotating brush 12 is indented with respect to the surface 20, a length of the tip portion is approximately the same as the indentation.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A nozzle arrangement for a cleaning device for cleaning a surface, said nozzle arrangement comprising:

a nozzle housing having an opening defined by a plurality of sides;

a single brush mounted in the nozzle housing and arranged to be rotated about a brush axis, said brush comprising a substantially cylindrical hollow core element having a plurality of distributed liquid-passage openings formed through a circumferential wall thereof and supporting a continuous array of flexible brush elements extending radially from a circumferential surface of the core element, said brush elements being arranged to extend through the nozzle housing opening to contact the surface to be cleaned and to pick up dirt particles and liquid from said surface during rotation of the brush;

a first one of said sides extending in a longitudinal direction substantially parallel to the brush axis, said first side being located where the brush elements leave the nozzle housing during rotation of the brush and projecting so as to contact ends of the brush elements during said rotation;

a wiping element for moving the dirt particles and liquid along the surface to be cleaned during movement of the cleaning device, said wiping element being arranged on a second longitudinally extending one of the sides defining the nozzle housing opening where the brush elements re-enter the nozzle housing during rotation of the brush, said second side being spaced apart from said re-entering brush elements to define a suction inlet for vacuuming the dirt particles and liquid from the surface to be cleaned;

at least one side-sealing element arranged for at least partially sealing a first lateral one of the sides defining the nozzle housing opening, said at least one side-sealing element being spaced apart from an end of the core element such that a gap is formed between said end of the core element and said at least one side-sealing element; and a liquid supply arrangement configured to supply cleansing liquid into the cylindrical core element for passage through the plurality of distributed liquid-passage openings in said core element to wet the flexible brush elements and from at least one opening facing the at least one side-sealing element and aimed to direct cleansing fluid into said gap.

2. A nozzle arrangement as claimed in claim 1 where said wiping element comprises a squeegee.

3. A nozzle arrangement as claimed in claim 1 where the at least one side-sealing element includes a first side-sealing element for at least partially sealing the first lateral one of the sides defining the nozzle housing opening and a second side-sealing element for at least partially sealing a second lateral one of the sides defining the nozzle housing opening;

where said first side-sealing element is spaced apart from a first end of the core element such that a first gap is formed between said first end of the core element and the first side-sealing element;

where said second side-sealing element is spaced apart from a second end of the core element such that a second gap is formed between said second end of the core element and the second side-sealing element;

and where the openings in the core element include first and second openings adjacent to said first and said second gaps to wet the surface to be cleaned in respective areas defined by said first and second gaps.

4. A nozzle arrangement as claimed in claim 1 where the liquid supply arrangement is configured to supply the cleansing liquid through the collective openings in the cylindrical core element at a maximum flow rate of 60 ml per minute and through the at least one opening facing the at least one side-sealing element at a maximum flow rate of 10 ml per minute.

5. A nozzle arrangement as claimed in claim 1 where the at least one side-sealing element is spring-loaded by means of a spring element in order to push said at least one side-sealing element against the surface to be cleaned.

6. A nozzle arrangement as claimed in claim 1 where the at least one side-sealing element comprises a brush with a plurality of bristles.

7. A nozzle arrangement as claimed in claim 1 where at least a first part of said at least one side-sealing element is arranged substantially perpendicularly to the brush axis.

8. A nozzle arrangement as claimed in claim 7 where a distance between the first part of the at least one side-sealing element and a lateral side of the wiping element that is transverse to the longitudinal direction is smaller than 5 mm.

9. A nozzle arrangement as claimed in claim 1 where a length of the at least one side-sealing element is equal to or larger than a distance between a section of the wiping element that has a maximum distance to the first side and a contact position where the first side contacts the brush.

10. A nozzle arrangement as claimed in claim 1 where a distance between the at least one side-sealing element and a lateral side of the first side that is transverse to the longitudinal direction is smaller than 5 mm.

11. A nozzle arrangement as claimed in claim 7 where a distance between the first part of the at least one side-sealing element and a lateral side of the wiping element that is transverse to the longitudinal direction is smaller than 2 mm.

12. A nozzle arrangement as claimed in claim 1 where a distance between the at least one side-sealing element and a lateral side of the first side that is transverse to the longitudinal direction is smaller than 3 mm.

13. A nozzle arrangement as claimed in claim 1 where the centrifugal force developed is sufficient to effect spraying of the cleansing liquid through the distributed liquid-passage openings in the core element.

14. A nozzle arrangement as claimed in claim 1 where the brush elements have a continuous minimum packing density of 30 tufts of brush elements per $cm^2$.

15. A cleaning device for cleaning a surface, said cleaning device comprising:

a nozzle arrangement including:

a nozzle housing having an opening defined by a plurality of sides;

a single brush mounted in the nozzle housing and arranged to be rotated about a brush axis, said brush comprising a substantially cylindrical hollow core element having a plurality of distributed liquid-passage openings formed through a circumferential wall thereof and supporting a continuous array of flexible brush elements extending radially from a circumferential surface of the core element, said brush elements being arranged to extend through the nozzle housing opening to contact the surface to be cleaned and pick up dirt particles and liquid from said surface during rotation of the brush;

a first one of said sides extending in a longitudinal direction substantially parallel to the brush axis, said first side being located where the brush elements leave the nozzle housing during rotation of the brush and projecting so as to contact ends of the brush elements during said rotation;

a wiping element for moving the dirt particles and liquid along the surface to be cleaned during movement of the cleaning device, said wiping element being arranged on a second longitudinally extending one of the sides defining the nozzle housing opening where the brush elements re-enter the nozzle housing during rotation of the brush, said second side being spaced apart from said re-entering brush elements to define a suction inlet for vacuuming the dirt particles and liquid from the surface to be cleaned;

at least one side-sealing element arranged for at least partially sealing a first lateral one of the sides defining the nozzle housing opening, said at least one side-sealing element being spaced apart from an end of the core element such that a gap is formed between said end of the core element and said at least one side-sealing element; and a liquid supply arrangement configured to supply cleansing liquid into the cylindrical core element for passage through the plurality of distributed liquid-passage openings in said core element to wet the flexible brush elements and from at least one opening facing the at least one side-sealing element and aimed to direct cleansing fluid into said gap;

a drive apparatus for rotating the brush; and a vacuum aggregate coupled to the nozzle housing opening for generating an under-pressure in a suction-area between the nozzle housing and the brush.

16. A cleaning device as claimed in claim 15 where a linear mass density of a plurality of the brush elements is, at least at tip portions of the brush elements, lower than 150 g per 10 km and where the drive apparatus is adapted to realize a centrifugal acceleration at the tip portions, during a dirt release period when the brush elements are free from contact with the surface, of at least 3,000 $m/s^2$.

17. A cleaning device as claimed in claim 15 where the vacuum aggregate is configured to generate, in a suction area between the nozzle housing, the brush and the wiping element, an under-pressure in one of:

a range of 3 to 70 mbar;

a range of 4 to 50 mbar; and a range of 5 to 30 mbar.

18. A cleaning device as claimed in claim 15 where the centrifugal force developed is sufficient to effect spraying of the cleansing liquid through the distributed liquid-passage openings in the core element.

19. A cleaning device as claimed in claim 15 where the brush elements have a continuous minimum packing density of 30 tufts of brush elements per $cm^2$.

* * * * *